US006421029B1

(12) United States Patent
Tanabe

(10) Patent No.: US 6,421,029 B1
(45) Date of Patent: Jul. 16, 2002

(54) HELICAL ANTENNA WITH CONNECTOR AND FABRICATION METHOD OF THE SAME

(75) Inventor: Kosuke Tanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/627,305

(22) Filed: Jul. 27, 2000

(30) Foreign Application Priority Data

Aug. 10, 1999 (JP) ..... 11-226259

(51) Int. Cl.[7] ..... H01Q 1/36

(52) U.S. Cl. ..... 343/895; 343/700 MS; 343/853; 343/702

(58) Field of Search ..... 343/700 MS, 702, 343/895, 906, 893

(56) References Cited

U.S. PATENT DOCUMENTS 5,828,348 A * 10/1998 Tassoudji et al. ..... 343/895
5,910,790 A 6/1999 Ohmuro et al.
6,034,650 A * 3/2000 Kuramoto ..... 343/895
6,072,441 A * 6/2000 Tanabe ..... 343/895

FOREIGN PATENT DOCUMENTS

| | | |
|---|---|---|
| EP | 0917241 A | 5/1995 |
| JP | 5-206719 | 8/1993 |
| JP | 6-326511 | 11/1994 |
| WO | WO99/33146 A1 | 7/1999 |

* cited by examiner

*Primary Examiner*—Don Wong
*Assistant Examiner*—Shih-Chao Chen
(74) *Attorney, Agent, or Firm*—Sughrue Mion, PLLC

(57) ABSTRACT

A helical antenna includes an element, a feeder circuit, and a connector that connects the element and feeder circuit. The element includes a cylindrical member composed of a dielectric and a plurality of radiation elements that are provided in helical form at intervals on the. outer surface of this cylindrical member. The feeder circuit is mounted on a circuit board that is arranged below the cylindrical member. The connector is arranged between the circuit board and the cylindrical member and is composed of an insulating material that is provided in a solid unit with connection pins that electrically connect the ends of the radiation elements to the circuit board.

44 Claims, 20 Drawing Sheets

HELICAL ANTENNA WITH CONNECTOR AND FABRICATION METHOD OF THE SAME

BACKGROUND OF THE INVENTION

1. Field of the Invention

The present invention relates to a helical antenna in which radiation elements are provided in helical form on the surface of a cylindrical member composed of a dielectric, and to a method of manufacturing this helical antenna.

2. Description of the Related Art

Helical antennas are used as the antennas for portable terminals in portable telephone systems that employ-non-geostationary satellites. FIG. 1 is a perspective view of an example of this type of helical antenna of the prior art.

Referring to FIG. 1, helical antenna 102 of the prior art is shown that includes element 100, feeder circuit 200, and connection pins 310. Element 100 is formed by winding flexible print circuit board 120 in the form of parallel quadrilaterals around dielectric pipe 110. Flexible print circuit board 120 is secured to dielectric pipe 110 by an adhesive or a double sided tape.

Feeder circuit 200 is formed from circuit board 104 (also referred to as a "dielectric board") made up from a disk-shaped dielectric having a larger diameter than dielectric pipe 110. Microstrip lines (not shown in the figure) are formed and a chip-type 4-distributor, resistor, and capacitor are mounted on one surface of dielectric board 104, these components having the function of a 4-distributor/combiner circuit. A ground conductor is formed on the other surface of dielectric board 104. Since this type of feeder circuit is well known in the art, and functionally, is not an element that is closely connected to the present invention, a detailed explanation of these components is omitted.

FIG. 2 is a sectional view showing the connection points between element 100 and feeder circuit 200 in helical antenna 102 shown in FIG. 1. In the figure, components identical to those shown in FIG. 1 bear the same reference numerals.

As shown in FIG. 2, a plurality of connection pins 310 are arranged at the edge of element 110. Each of connection pins 310 passes through a through-hole formed in dielectric board 104 of feeder circuit 200. One end of connection pins 310 is soldered to element 100 and the other is soldered to feeder circuit 200.

In the configuration of helical antenna 102 of the prior art, element 100 and dielectric board 104 are connected by inserting connection pins 310 through dielectric board 104, and the outside diameter of feeder circuit 200 is therefore greater than the outside diameter of dielectric pipe 110. This factor is not advantageous for reducing the outside diameter of helical antenna 102.

An antenna that is incorporated into a portable telephone is preferably as compact as possible, and, for example, a helical antenna of the following construction has been proposed to eliminate the above-described drawback.

FIG. 3 is a perspective view showing another example of a helical antenna of the prior art. In the figure, constituent elements identical to those of FIG. 1 bear the same reference numerals.

Helical antenna 106 shown in FIG. 3 includes element 100A, feeder circuit 200A, and connection pins 310. Element 100A is formed by winding flexible print circuit board 120A, which is shaped as a parallel quadrilateral, around dielectric pipe 110A. The outside diameter of feeder circuit 200A is somewhat larger than the outside diameter of element 100. The electrical configuration of feeder circuit 200A is the same as that of feeder circuit 200 shown in FIG. 1.

FIG. 4 is a sectional view showing in detail the connection points between element 100A and feeder circuit 200A in the helical antenna 106 shown in FIG. 3. In the figure, constituent elements that are the same as those shown in FIG. 3 bear the same reference numerals.

The walls of dielectric pipe 110A are thicker on the side of feeder circuit 200A than in other portions of dielectric pipe 110A. and holes for inserting connection pins 310 are formed in this thicker portion of dielectric pipe 110A. Flexible print circuit board 120A is wound around dielectric pipe 110A such that its lower end-bends inwards at the lower end of dielectric pipe 110A. Flexible print circuit board 120A is secured to dielectric pipe 110A by means of an adhesive or a double sided tape.

The upper ends of connection pins 310 are inserted into the above-described holes in dielectric pipe 110A, and the lower ends are inserted into through-holes formed in dielectric board 104 of feeder circuit 200A. Connection pins 310 are then connected to feeder circuit 200A by soldering at these through-holes. The upper ends of connection pins 310, on the other hand, are soldered to the end of flexible print circuit board 120A that is bent inside dielectric pipe 110A.

This helical antenna 106 allows each of connection pins 310 to be provided at points closer to the center of dielectric board 104 than in helical antenna 102 shown in FIG. 1, and the outside diameter of feeder circuit 200A can therefore be made smaller than that of feeder circuit 200 shown in FIG. 1.

Nevertheless, this helical antenna 106 has the drawback that the process of winding flexible print circuit board 120A around dielectric pipe 110A is complicated by the necessity of bending the lower end of flexible print circuit board 120A inside the lower end of dielectric pipe 110A. A further drawback is the increased number of fabrication steps required for forming holes in dielectric pipe 110A for inserting connection pins 310.

SUMMARY OF THE INVENTION

It is an object of the present invention to provide a helical antenna that is compact and that can be assembled reliably in a short time, as well as a method of fabricating the helical antenna.

To achieve the above-described objects, the helical antenna according to the present invention comprises a plurality of radiation elements provided in helical form that are spaced at intervals from each other on the outer surface of a cylindrical member that is composed of a dielectric, a circuit board on which is mounted a feeder circuit for supplying high-frequency energy to the radiation elements, and a connector for electrically connecting the radiation elements and the circuit board. The circuit board is arranged below the cylindrical member, and the connector is arranged between the lower end of the cylindrical member and the circuit board. The connector is composed of an insulating material and is provided as a solid unit with a plurality of connection pins that electrically connect the end of each radiation element with the circuit board.

According to a preferable embodiment of the present invention, the connector includes a connector body, and the plurality of connection pins are provided on the connector body. The connector body includes a lower portion that is formed with an outside diameter that is substantially equal to the outside diameter of the cylindrical member and an upper portion that is formed with an outside diameter that allows insertion inside the cylindrical member with substantially no gap. The lower ends of the connection pins protrude downward from the lower surface of the lower portion of the connector body. The upper ends of the connection pins protrude upward from the lower portion of connector body with a gap between the connection pins and the outer surface of the upper portion of the connector body. The connector body is then joined to the cylindrical member by inserting the upper portion of the connector body into the lower end of the cylindrical member and interposing the lower end of the cylindrical member between the outer surface of the upper portion of the connector body and the upper ends of the connection pins. The upper ends of the connection pins are thus electrically connected to the ends of the radiation elements, and moreover, the lower ends of the connection pins are electrically connected to the circuit board.

In the fabrication method of the helical antenna according to the present invention, a cylindrical member, a circuit board, and a connector composed of an insulating material are prepared beforehand. A plurality of helical radiation elements are provided at intervals on the outer surface of the cylindrical member. A feeder circuit for supplying high-frequency energy to the radiation elements is mounted on the circuit board. A plurality of connection pins for electrically connecting the ends of the radiation elements to the circuit board are provided as a solid unit with the connector. Then, the connector is installed on the circuit board and the connection pins are electrically connected to the feeder circuit, and in addition, the connector is attached to the lower end of the cylindrical member and the connection pins are electrically connected to the ends of the radiation elements.

According to a preferable embodiment of the fabrication method of the helical antenna of this invention, the connector includes a connector body composed of an insulating material, and the plurality of connection pins are provided as a solid unit with this connector body. The lower ends of the connection pins protrude downward from the lower surface of the lower portion of the connector body. The upper ends of the connection pins protrude upward from the lower portion of the connector body and form a gap with respect to the outer surface of the upper portion of the connector body. The connector body and cylindrical member are then joined by inserting the upper portion of the connector body into the lower end of the cylindrical member and interposing the lower end of the cylindrical member between the upper ends of the connection pins and the outer surface of the upper portion of the connector body, thereby electrically connecting the upper ends of the connection pins and the ends of the radiation elements, and further, electrically connecting the lower ends of the connection pins to the circuit board.

According to the present invention, radiation elements provided on the outer surface of the cylindrical member are connected by means of a connector to a feeder circuit that is mounted on a circuit board. Accordingly, a connector body provided as a solid unit with connection pins is of a construction that includes a lower portion that is formed with substantially the same outside diameter as the outside diameter of a cylindrical member and an upper portion that is formed with an outside diameter that allows insertion inside the cylindrical member with substantially no gap; the lower ends of the connection pins are configured to protrude from the lower surface of the lower portion of the connector body, and the upper ends of the connection pins are configured to extend upward from the lower portion of the connector body such that a gap is formed between the upper ends of the connection pins and the outer surface of the upper portion of the connector body; whereby the diameter of the circuit board can be made equal to or less than the outside diameter of the cylindrical member. In addition, the diameter of the connector can also be made substantially equal to the diameter of the cylindrical member. As a result, a slimming of the entire helical antenna can be achieved.

When assembling the helical antenna, the cylindrical member and circuit board need only be connected by way of the connector. In particular, a construction in which the connector body includes an upper portion and lower portion as described hereinabove and the upper ends of the connection pins are constructed as described hereinabove enables the radiation elements to be electrically connected to the connection pins by inserting the upper portion of the connector body into the lower end of the cylindrical member and interposing the ends of the radiation elements between the upper ends of the connection pins and the outer surface of the upper portion of the connector body. The ends of the radiation elements and the upper ends of the connection pins may also be soldered together as necessary.

In a case in which the radiation elements are constituted by metal foil patterns formed on a dielectric sheet, the radiation elements can be provided in helical form on the outer surface of the cylindrical member by wrapping the dielectric sheet around a cylindrical member. In this case as well, adopting a construction in which the radiation elements are interposed between the outer surface of the upper portion of the connector body and the upper ends of the connection pins as described above eliminates the need for bending the lower end of the dielectric sheet toward the center of the cylindrical member, as in the prior art, and further, eliminates the need to form holes for inserting connection pins in the end surface of the cylindrical member.

The present invention therefore enables easy, reliable, and speedy assembly of a helical antenna without need for special methods.

In addition, the terms "upper" and "lower" that are used in the present invention indicate "up" and "down" when the helical antenna is in an erect state in which the feeder circuit is positioned below the cylindrical member, and do not necessarily indicate "up" or "down" when the helical antenna is in use or when the helical antenna is being assembled.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 1:
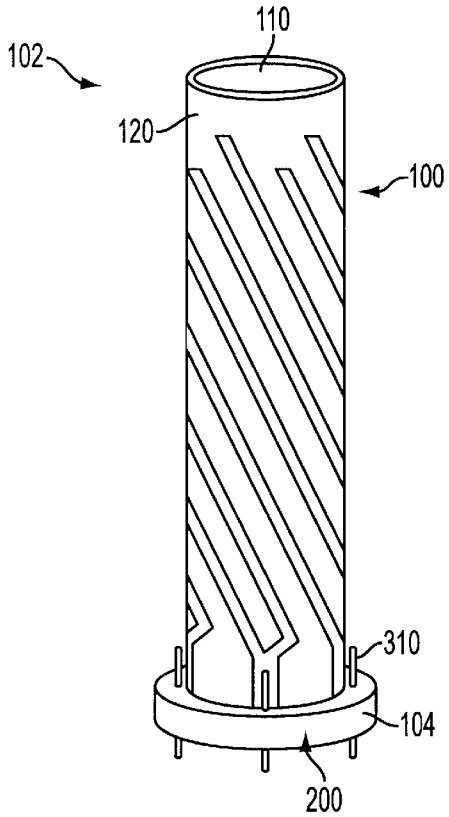
FIG. 1 (PRIOR ART)
FIG. 1 is a perspective view of one example of a helical antenna of the prior art.
Figure 2:
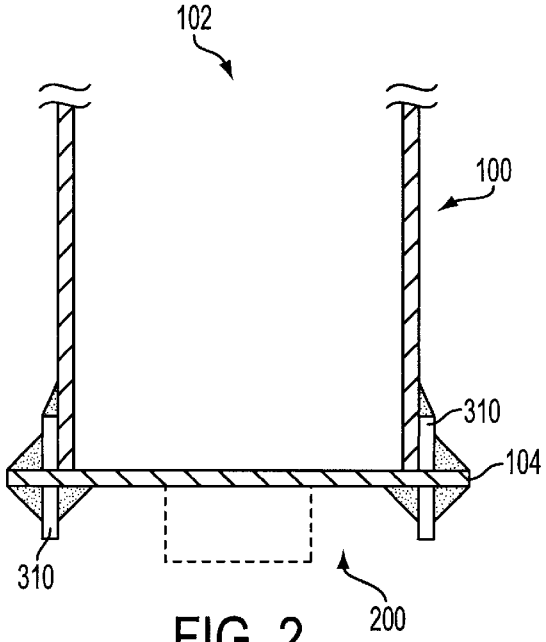
FIG. 2 (PRIOR ART)
FIG. 2 is a section showing the connection points between elements and the feeder circuit in the helical antenna of FIG. 1.

Referring now to FIGS. 5–17, the first embodiment of the present invention is next explained. In the figures, constituent elements that are equivalent to the prior art bear the same reference numerals.

Figure 5:
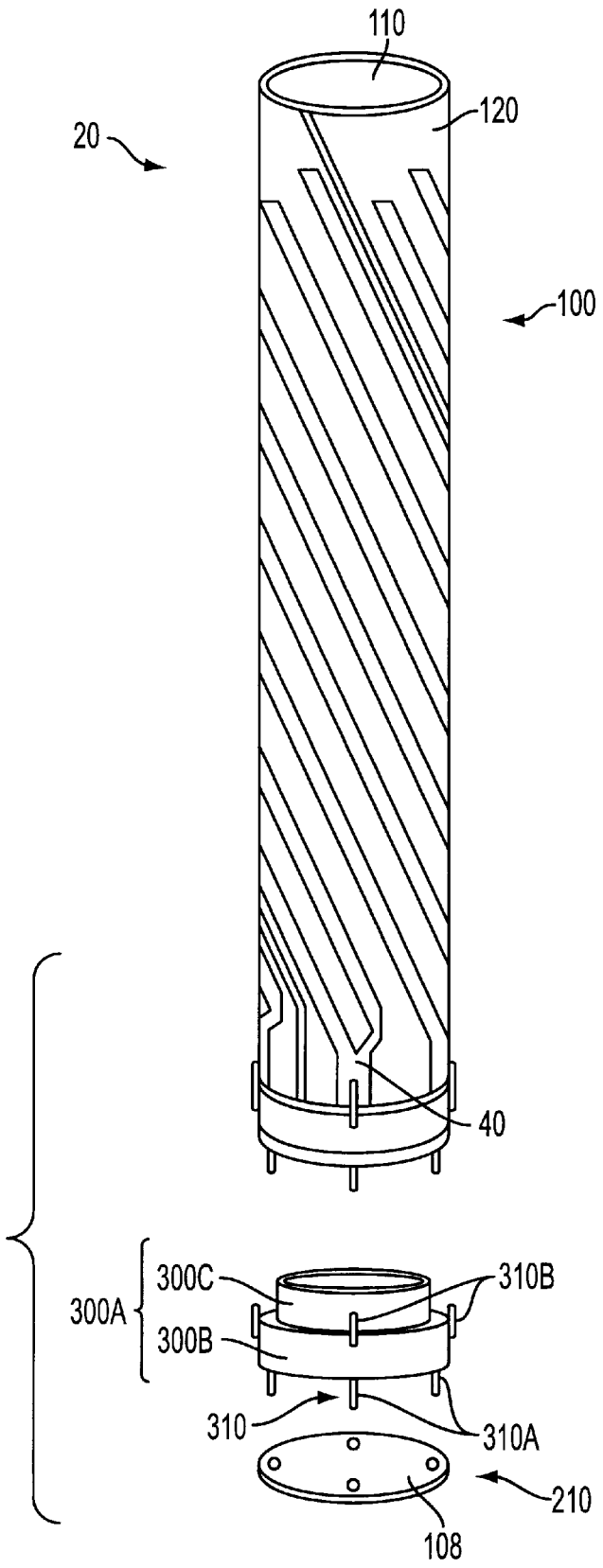
FIG. 5 is an exploded perspective view of a helical antenna according to the first embodiment of the present invention.
Figure 6:
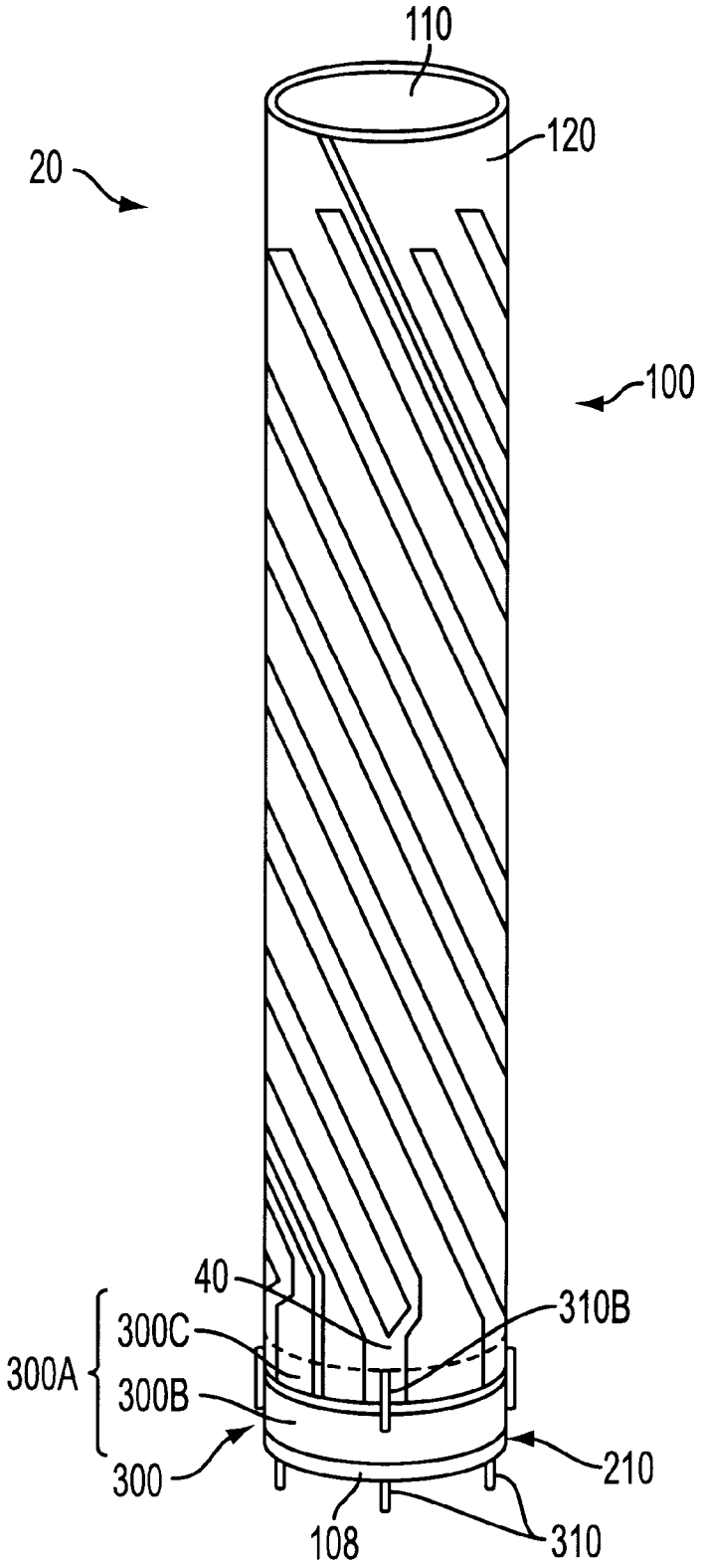
FIG. 6 is a perspective view showing the helical antenna of FIG. 5 after assembly.

Referring to FIG. 5 and FIG. 6, in which helical antenna 20 according to the first embodiment of the present invention is shown, this helical antenna 20 comprises element 100, feeder circuit 210, and connectors 300 for connecting element 100 and feeder circuit 210.

Element 100 is formed by winding flexible print circuit board 120 (a dielectric sheet) around the outer surface of cylindrical dielectric pipe 110 (a cylindrical member) and securing with an adhesive or a double sided tape.

Materials such as polycarbonate, Teflon (registered trademark of Dupont), PTFE (polytetrafluoroethylene), and ABS may be applied as the material of dielectric pipe 110.

Figure 7:
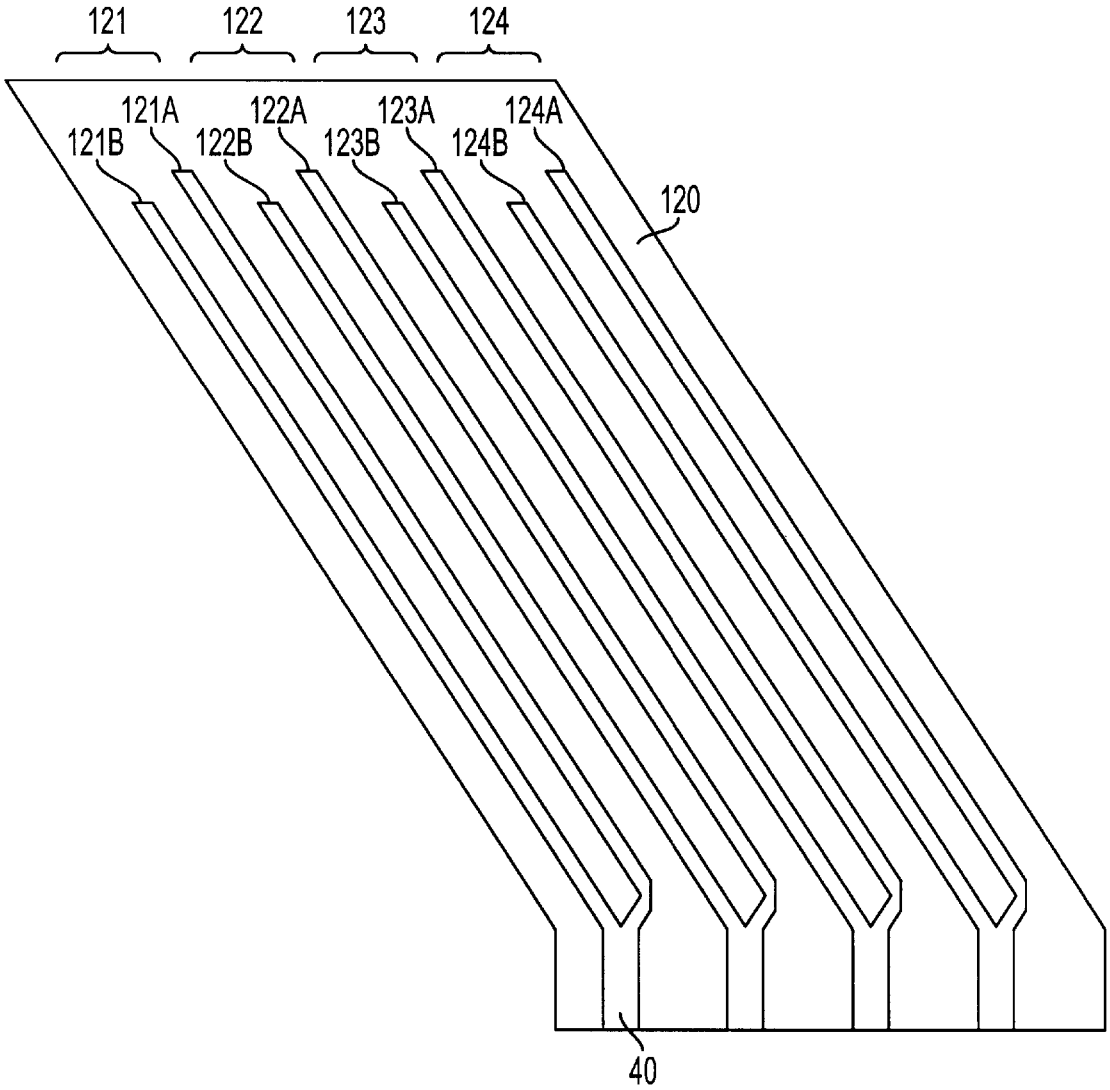
FIG. 7 is a plan development of the flexible print circuit board that makes up a part of the helical antenna of FIG. 5.

As shown in FIG. 7, if rolled out flat, flexible print circuit board 120 is constituted by a parallel quadrilateral. Y-shaped elongated copper foil patterns 121, 122, 123, and 124 (radiation elements) composed of first copper foil patterns 121A–124A and second copper foil patterns 121B–124B are formed at intervals on the surface of flexible print circuit board 120 and substantially parallel to each other. Copper foil patterns 121, 122, 123, and 124 form a helix when flexible print circuit board 120 is wound onto dielectric pipe 110, as shown in FIG. 5. A material such as polyimide may be applied as the material of flexible print circuit board 120.

A first copper foil pattern and a second copper foil pattern of each copper foil pattern are connected at one end, this point forming base 40 (radiation element base) that exhibits a Y-shape.

Figure 8:
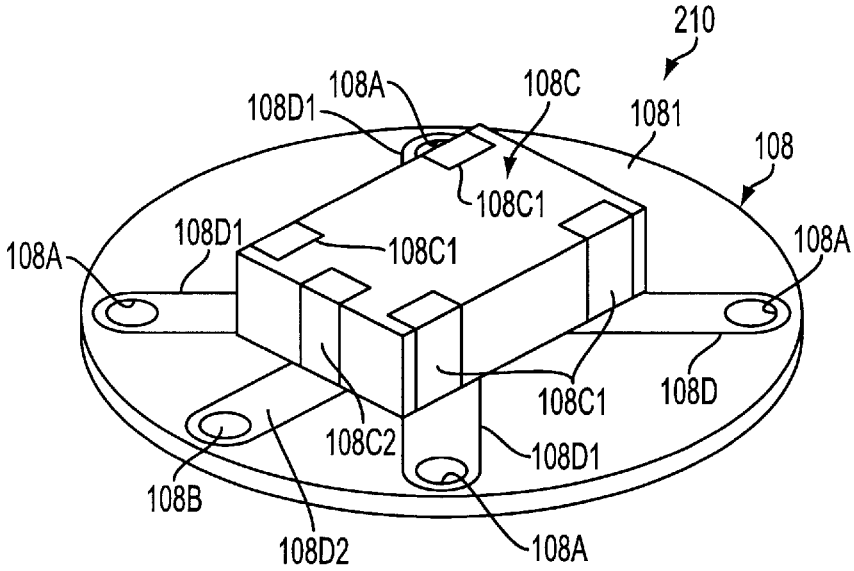
FIG. 8 is a perspective view showing the feeder circuit that makes up a part of the helical antenna of FIG. 5 turned upside down.
Figure 9:
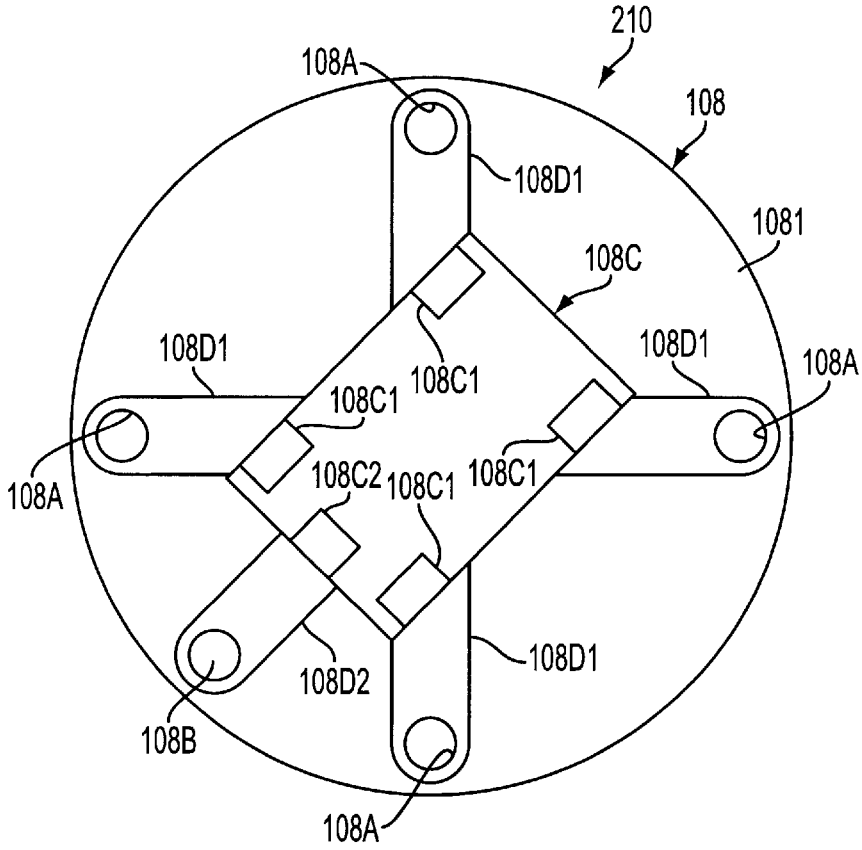
FIG. 9 is a plan view of the feeder circuit that makes up a part of the helical antenna of FIG. 5 as seen from below.
Figure 10:
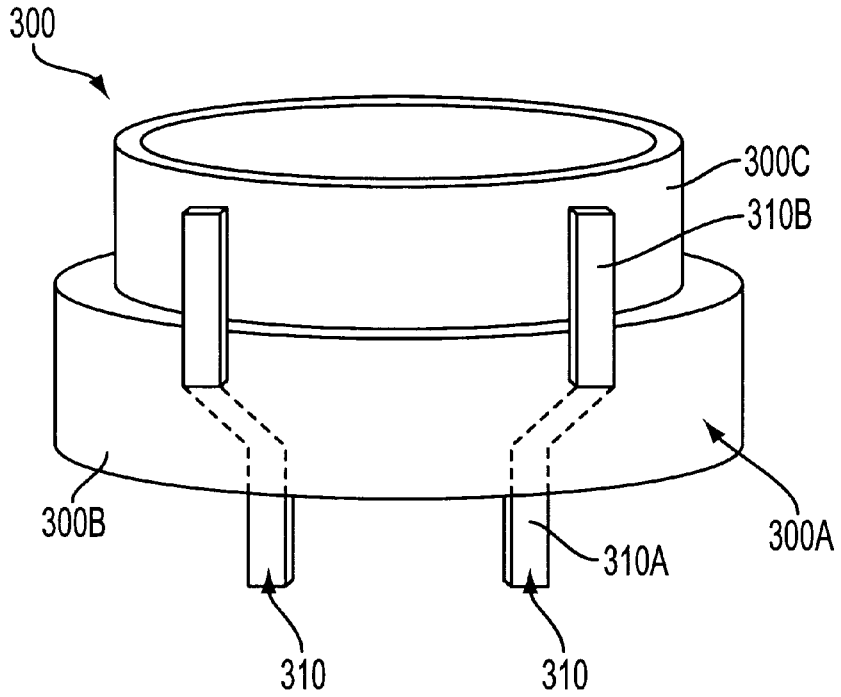
FIG. 10 is a detailed perspective view showing the connector that makes up a part of the helical antenna of FIG. 5.
Figure 11:
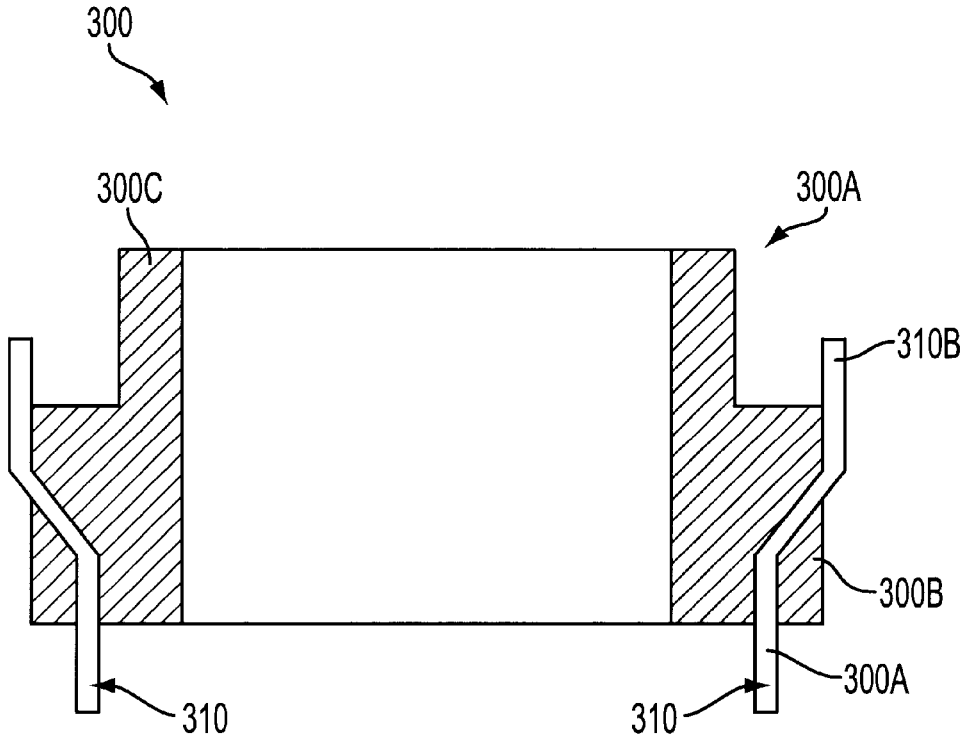
FIG. 11 is a detailed side sectional view of the connector that makes up a part of the helical antenna of FIG. 5.
Figure 12:
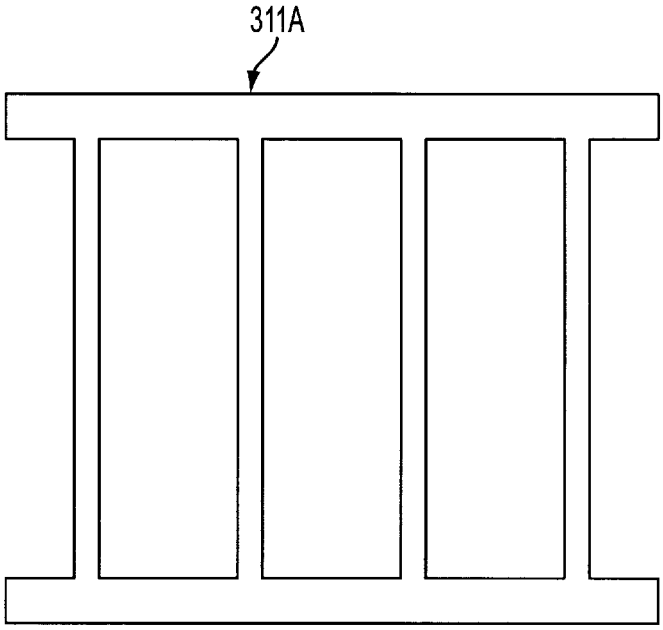
FIG. 12 is a plan view of the bar piece for explaining one method of fabricating the connection pins that make up a part of the connector.

As shown in FIG. 8 and FIG. 9, feeder circuit 210 has disk-shaped dielectric board 108 of approximately the same diameter as dielectric pipe 110.

Four through-holes 108A that pass through dielectric board 108 in the direction of thickness are provided at points along the edge of dielectric board 108 that correspond to lower ends 310A of connection pins 310 (to be described below), these lower ends 310A being inserted through these through-holes 108A. In addition, one through-hole 108BC through which passes a connection pin (not shown) that is connected to a transmitting/receiving circuit (not shown), is provided in dielectric board 108 in the direction of thickness of dielectric board 108. Chip-type 4-distributor/combiner circuit 108C is provided on lower surface 1081 of dielectric board 108. This 4-distributor/combiner circuit 108C is provided with four antenna-side connection ports 108C1 and one input/output port 108C2. Microstrip lines 108D1 that connect each antenna-side connection port 108C1 to a respective through-hole 108A and microstrip line 108D2 that connects input/output port 108C2 and through-hole 108B are formed on lower surface 1081 of dielectric board 108.

A ground conductor is formed on the upper surface groud of dielectric board 108, i.e., the surface that confronts element 100.

Referring next to FIGS. 10–13, connector 300 that makes up a part of helical antenna 20 of FIG. 5 is described.

Connector 300 includes connection pins 310 and ring 300A that is composed of plastic resin and that constitutes the connector body. Lower portion 300B of ring 300A is formed with an outside diameter that is substantially equal to the outside diameter of dielectric pipe 110, and upper portion 300C of ring 300A is formed with an outside diameter that allows insertion into dielectric pipe 110 with substantially no gap.

Lower ends 310A of connection pins 310 protrude downward from the lower surface of lower portion 300B of ring 300A, and upper ends 310B protrude upward from lower portion 300B of ring 300A so as to form a gap between upper ends 310B and the outside surface of upper portion 300C of ring 300A. In more detail, upper ends 310B of connection pins 310 protrude from the outer surface of lower portion 300B of ring 300A and extend upward along the outer surface of upper portion 300A. The middle portions of connection pins 310 therefore are buried inside lower portion 300B of ring 300A.

In addition, connection pins 310 are bent in the middle portion such that lower ends 310A protrude from the lower surface of lower portion 300B of ring 300A at points that closer to the center in the radial direction of ring 300A than upper ends 310B.

Figure 13:
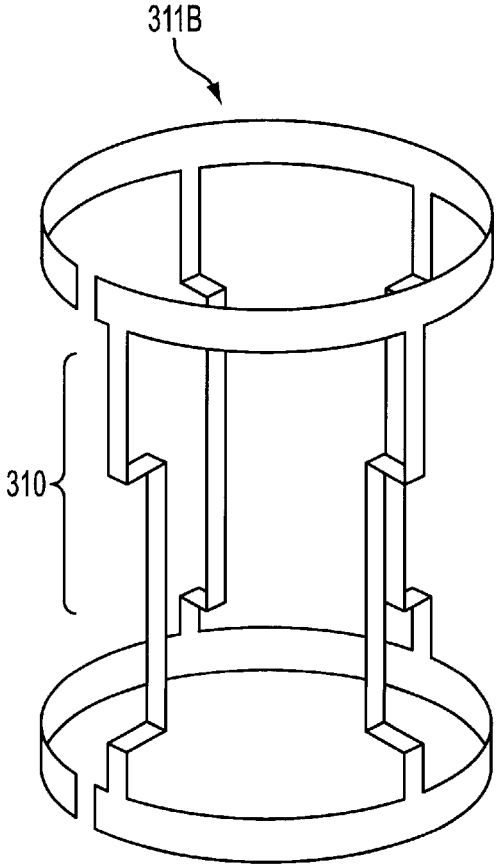
FIG. 13 is a perspective view of the bent bar piece for explaining one fabrication method of the connection pins that make up a part of the connector.

One example of a method forming connection pins 310 as a solid unit with ring 300A is next described. A metal plate of, for example, brass, is first punched out by a sheet metal processing method to form bar piece 311A of the shape shown in FIG. 12. This bar piece 311A is shaped by a bending process to form die insert piece 311B as shown in FIG. 13. This die insert piece 311B is next preset in a prescribed position of a forming die for forming ring 300A, and insert forming of die insert piece 311B is carried out, whereby die insert piece 311B is formed as a solid piece with the plastic resin that constitutes ring 300A. After forming, the unnecessary parts of the upper portion and lower portion of die insert piece 311B are cut off, and the remaining portions become the four independent connection pins 310. The use of brass as the material for connection pins 310 as described above is preferable because brass facilitates soldering.

As shown in FIG. 6, upper portion 300C of ring 300A is inserted into the lower end of dielectric pipe 110, the lower end of dielectric pipe 110 is held between the outer surface of upper portion 300C of ring 300A and upper ends 310B of connection pins 310, thereby joining ring 300A to dielectric pipe 110. Upper ends 310B of each of connection pins 310 each contact bases 40 of each of copper foil patterns 121–124, thereby establishing electrical connections between each of connection pins 310 and a respective copper foil pattern 121–124. In order to establish good electrical contact between each of connection pins 310 and respective copper foil patterns 121–124, upper ends 310B of connection pins 310 are preferably each soldered to bases 40 of copper foil patterns 121–124.

Lower ends 310A of each of connection pins 310 are electrically connected to feeder circuit 210, which is arranged below connector 300. In other words, lower ends 310A of connection pins 310, having been inserted through four through-holes 108A that are formed in dielectric board 108 of feeder circuit 210 that is shown in FIG. 8 and FIG. 9, electrically connect with each microstrip line 108Di by soldering. Accordingly, lower ends 310A of connection pins 310 electrically connect by way of each microstrip line 108D1 with antenna-side connection ports 108C1 of 4-distributor/combiner 108C on dielectric board 108.

Upper ends 310B of connection pins 310, on the other hand, as described hereinabove, make contact with, and are soldered to bases 40 of copper foil patterns 121–124. Copper patterns 121–124 are thus electrically connected to feeder circuit 210 by way of connection pins 310 of connector 300.

Figure 14:
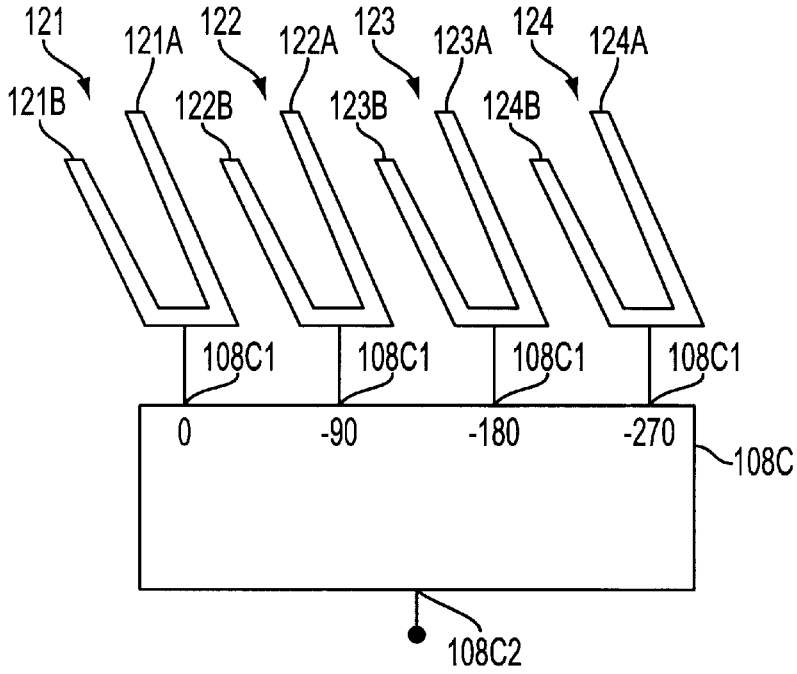
FIG. 14 is a block diagram showing the construction of the helical antenna of FIG. 5.

Referring now to FIG. 14, which is a block diagram showing the configuration of helical antenna of FIG. 5, the electrical operation of helical antenna 20 configured according to the foregoing description is next explained. The following explanation pertains to a case in which this helical antenna 20 is used as a satellite telephone antenna that uses a non-geostationary satellite.

The lengths of first copper patterns 121A–124A and second copper pattern 121B–124B are set such that first copper foil patterns 121A–124A resonate at a first frequency and second copper foil patterns 121B–124B resonate at a second frequency. The first frequency is used as the transmitting band and the second frequency is used as the receiving band. In this embodiment, moreover, the first frequency is set to a lower frequency than the second frequency, and first copper foil patterns 121A–124A are therefore longer than second copper foil patterns 121B–124B.

The four antenna-side connection ports 108C1 of 4-distributor/combiner circuit 108C are configured to receive and output signals that are of equal amplitude but that differ from each other by 90-degree phase shifts (in the figure, these are shown as 0-degrees, −90 degrees, −180 degrees, and −270 degrees).

Input/output port 108C2 of 4-distributor/combiner circuit 108C is connected to a transmitting/receiving circuit (not shown in the figure) by way of the connection pin (not shown in the figure) that passes through through-hole 108B (refer to, for example, FIG. 8) and microstrip line 108D2 (refer to, for example, FIG. 8). Transmission signals are received from this transmitting/receiving circuit, and received signals that have been combined by 4-distributor/combiner circuit 108C are outputted to this transmitting/receiving circuit.

Each of antenna side connection ports 108C1 is connected by the above-described connector 300 to a respective lower end of each of copper foil patterns 121–124.

Explanation first regards operation when transmitting.

When a high-frequency signal of the first frequency is received at input/output port 108C2 of 4-distributor/combiner circuit 108C from the transmitting/receiving circuit, 4-distributor/combiner circuit 108C distributes the high-frequency signal of the first frequency and outputs to antenna-side connection ports 108C1. At this time, signals that are of equal amplitude but of phases that differ by shifts of 90 degrees are outputted to each of antenna-side connection ports 108C1. Each of the distributed high-frequency signals is received at a respective copper foil pattern 121–124 by way of a respective connection pin 310 of connector 300. Each of the high-frequency signals that is received at a copper foil pattern 121–124 resonates at first copper foil pattern 121A–124A of copper foil patterns 121–124, is converted to electromagnetic waves, and is radiated into space. The electromagnetic waves that are radiated from the four first copper foil patterns 121A–124A can be combined at a space that is sufficiently separated from this helical antenna 20 to obtain a desired radiation pattern.

Next, the operation during reception is described.

High-frequency signals of the second frequency that are transmitted from a satellite are received at the four second copper foil patterns 121B–124B, and then applied to each of antenna-side connection ports 108C1 of 4-distributor/combiner circuit 108C by way of each of connection pins 310 of connector 300. At this time, each of the high-frequency signals of the second frequency are of equal amplitude but differ from each other by 90-degree phase shifts. 4-distributor/combiner circuit 108C combines these received high-frequency signals of the second frequency and outputs from input/output port 108C2 to the transmitting/receiving circuit. The transmitting/receiving circuit then performs a reception process based on the high-frequency signal that is received from input/output port 108C2.

As described in the foregoing explanation, helical antenna 20 of this embodiment is of a construction in which element 100 and feeder circuit 210 are connected by connector 300, and connector 300 is constructed such that lower ends 310A of connection pins 310 protrude downward from the lower surface of lower portion 300B of ring 300A, and upper ends 310B of connection pins 310 protrude from the outer surface of lower portion 300B of ring 300A and extend upward along this same outer surface. The outside diameter of lower portion 300B of connector 300 can therefore be set to substantially the same dimension as the outside diameter of dielectric pipe 110 as described hereinabove. In addition, connection pins 310 are bent in their middle portions such that the portion of lower ends 310A that protrudes downward from the lower surface of lower portion 300B of ring 300A is positioned more toward the inside of ring 300A in the radial direction of ring 300A than upper ends 310B. As a result, the outside diameter of dielectric board 108 can be made equal to or smaller than the outside diameter of element 100.

Helical antenna 20 of this embodiment thus enables a slimmer, i.e., more compact, form.

The assembly of helical antenna 20 can be realized by inserting connector 300, in which feeder circuit 210 is mounted on lower portion 300B, into the lower end of dielectric pipe 110 such that its upper portion 300C is arranged inside dielectric pipe 110, and then connecting upper ends 310B of each of connection pins 310 to bases 40 of copper foil patterns 121–124 by soldering.

Figure 3:
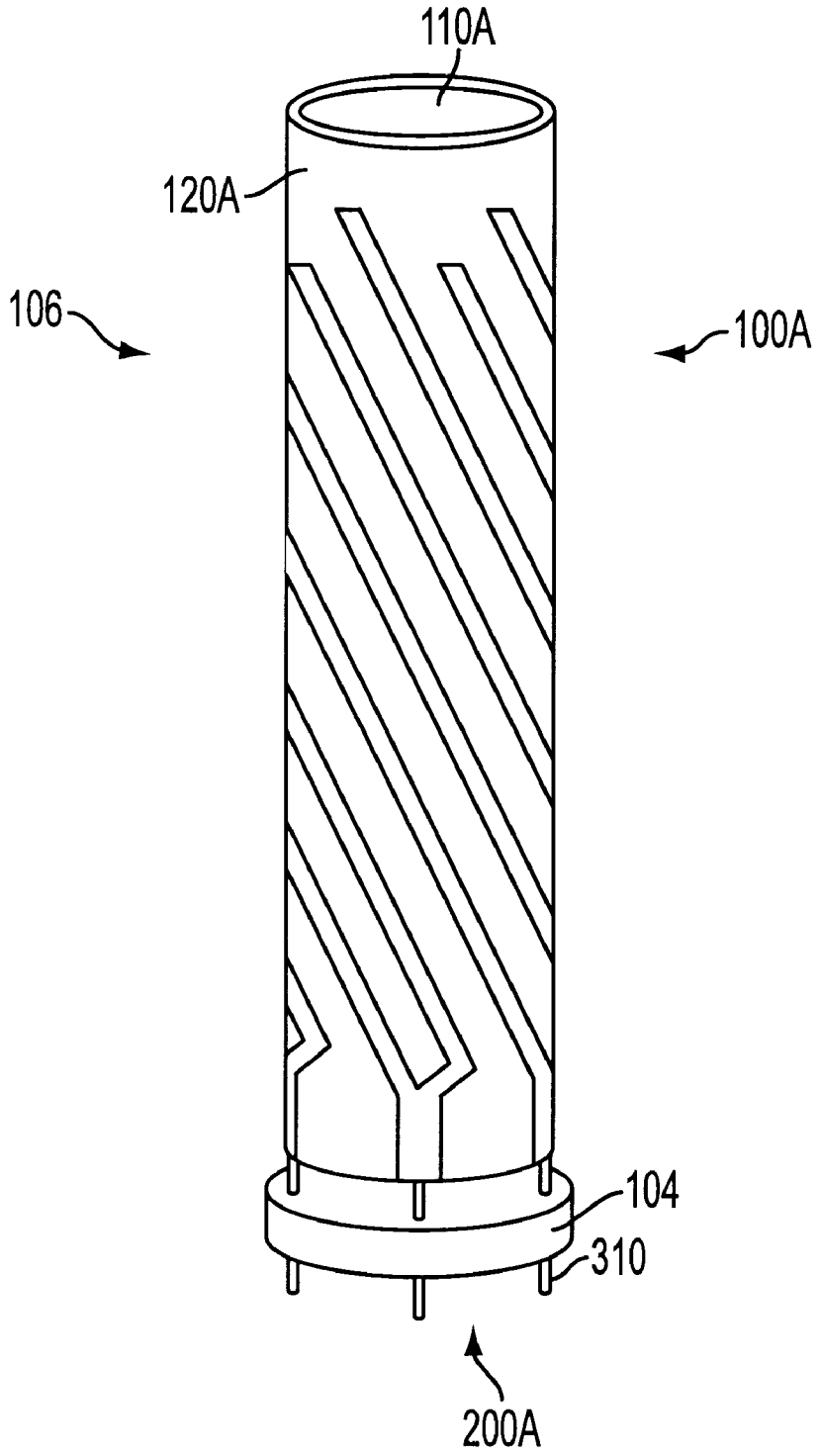
FIG. 3 (PRIOR ART)
FIG. 3 is a perspective view showing another example of a helical antenna of the prior art.
Figure 4:
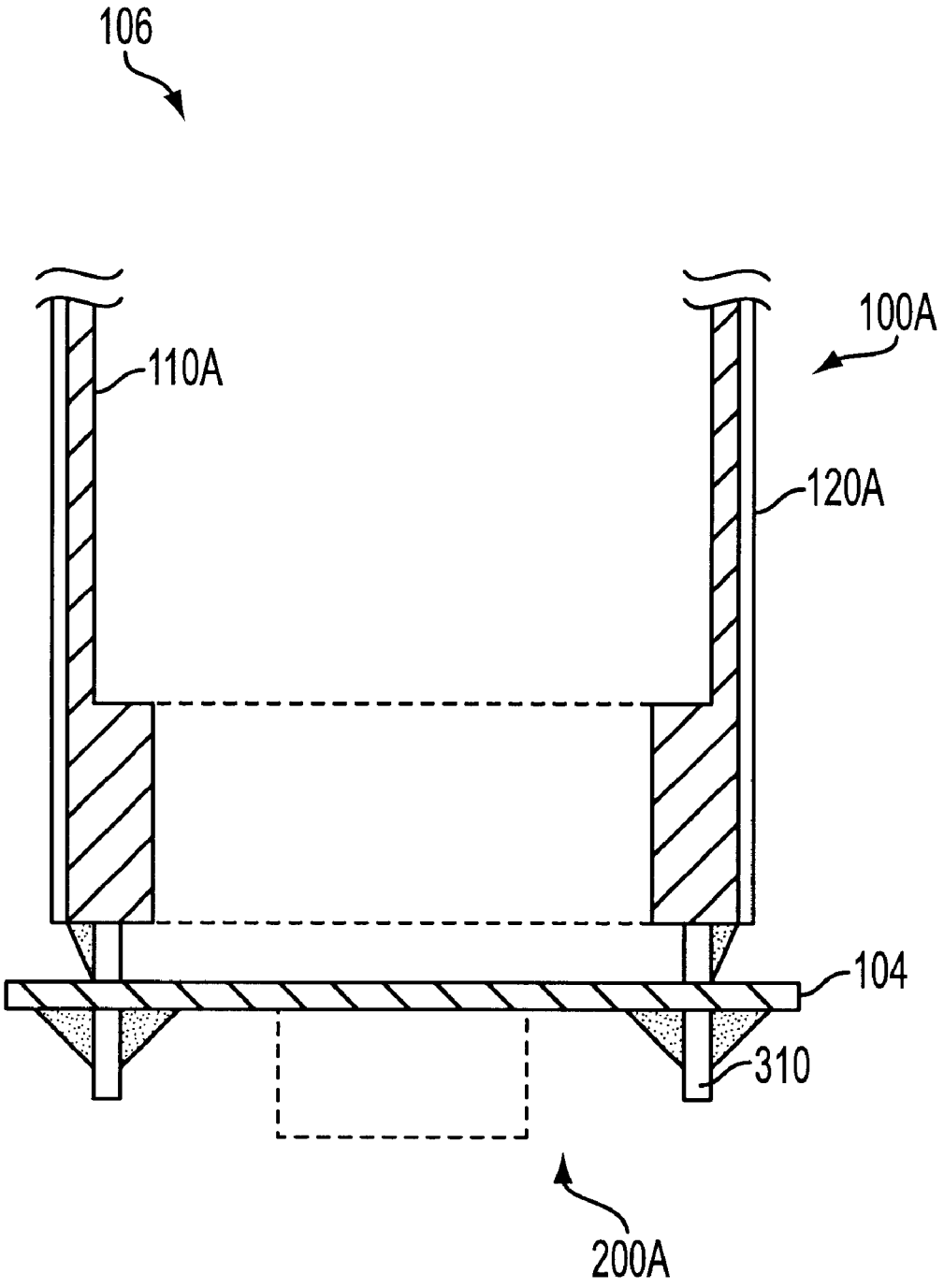
FIG. 4 (PRIOR ART)
FIG. 4 is a section showing a detailed view of the connection points between the element and feeder circuit in the helical antenna of FIG. 3.

In addition, there is no need to bend the lower end of flexible print circuit board 120 toward the center of dielectric pipe 110 when winding flexible print circuit board 120 onto dielectric pipe 110, as with the helical antennas of the prior art that are shown in FIG. 3 and FIG. 4, and further, there is no need to form holes for inserting connection pins in the end surface of dielectric pipe 110.

Helical antenna 20 of this embodiment therefore can be quickly and easily assembled.

Figure 15:
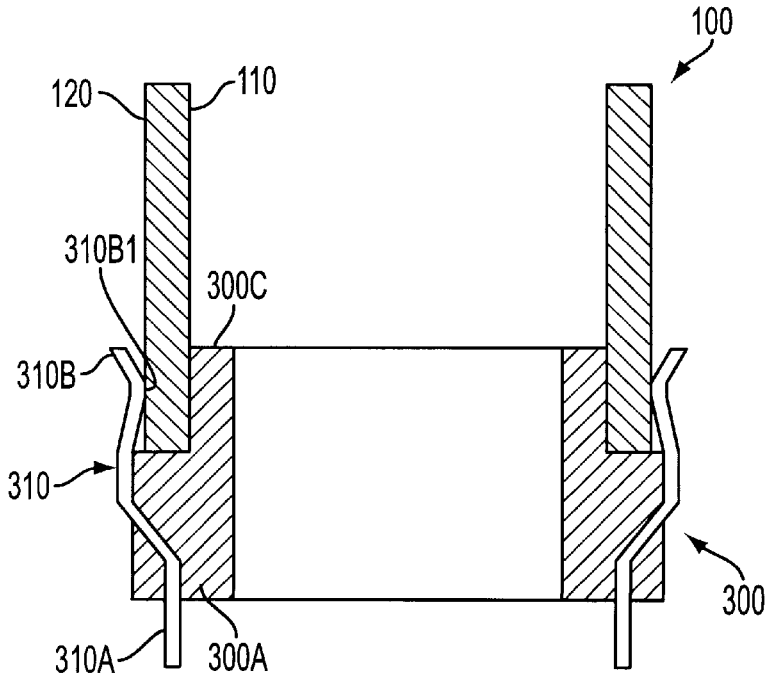
FIG. 15 is a vertical section showing the construction of a modification of the connector.

Although solder was used to connect upper ends 310B3 of each of connection pins 310 to bases 40 of copper foil patterns 121–124 in the above-described embodiment, a construction that does not require soldering may also be adopted if a connector such as is shown in FIG. 15 is used.

In the modification of connector 300 that is shown in FIG. 15, bent portions 310B1, which are bent in the direction that approaches the outer surface of upper portion 300C, are formed in the portions of upper ends 310B of connection pins 310 that protrude from the outer surface of lower portion of ring 300A and extend upward along the outer surface of upper portion 300B.

These bent portions 31011 are constructed so as to elastically press against bases 40 of each of copper foil patterns 121–124 when upper portion 300C of connector 300 is inserted into the lower end of dielectric pipe 110.

The elastic pressure of bent portions 310B1 of connection pins 310 against bases 40 of each of copper foil patterns 121–124 according to the above-described construction establishes electrical contact between upper ends 310B of connection pins 310 and bases 40 of each of copper foil patterns 121–124 and thus eliminates the need for a soldering step.

In addition, the shape of the copper foil patterns that are formed on the flexible print circuit board that constitutes the helical antenna is not limited to the elongated Y-shaped form such as shown in FIG. 7.

Figure 16:
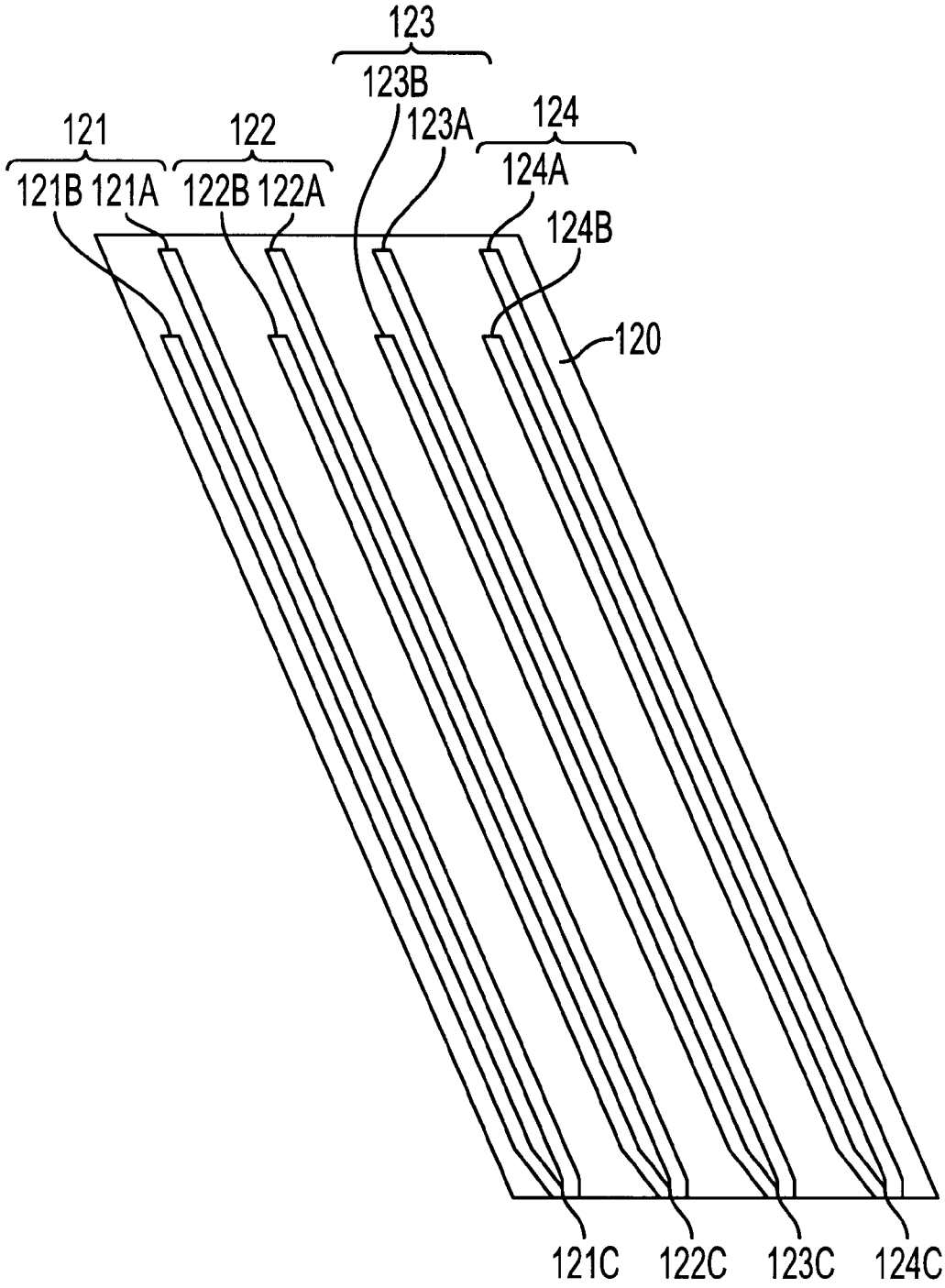
FIG. 16 is a plan development showing a modification of the flexible print circuit board that makes up a part of the helical antenna.
Figure 17:
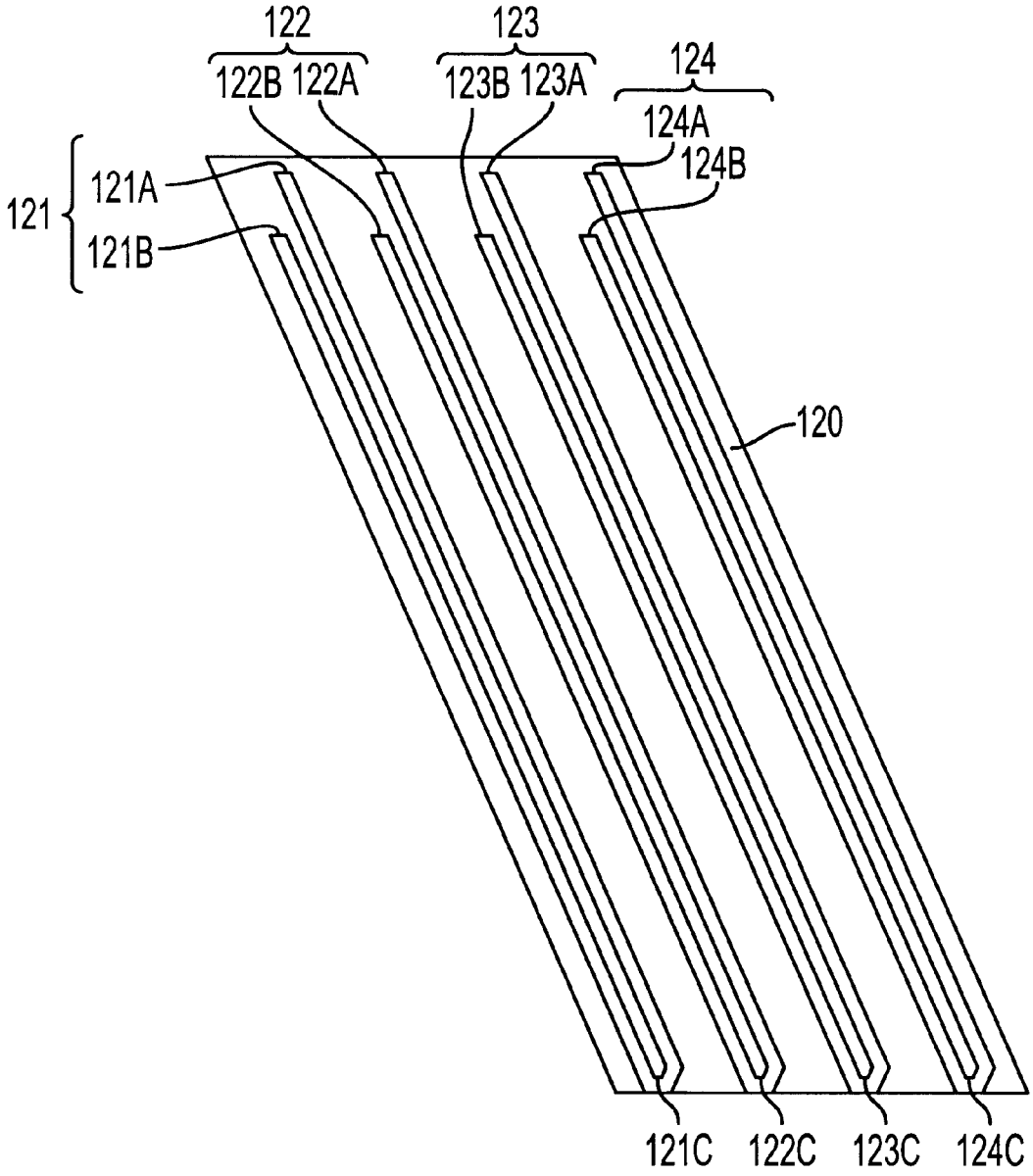
FIG. 17 is a plan development showing another modification of the flexible print circuit board that makes up a part of the helical antenna.

A number of examples of the shape of the copper foil patterns that are formed on the flexible print circuit board are shown in FIG. 16 and FIG. 17.

In flexible print circuit board 120 of FIG. 16, copper foil patterns 121–124 include first copper foil patterns 121A–124A and second copper foil patterns 121B–124B that extend substantially parallel to each other, and connection points 121C–124C (radiation element bases) that connect the lower ends of both first copper foil patterns 121A–124A and second copper foil patterns 121B–124B. Connection points 121C–124C exhibit V shapes with acute bends.

In flexible print circuit board 120 of FIG. 17, copper foil patterns 121–124 include first copper foil patterns 121A–124A and second copper foil patterns 121B–124B that extend substantially parallel to each other, and connection points 121C–124C (radiation element bases) that connect the lower ends of both first copper foil patterns 121A–124A and second copper foil patterns 121B–124B. Connection points 121C–124C exhibit U shapes with acute bends.

Connection points 121C–124C of FIG. 16 and FIG. 17 correspond to bases 40 of FIG. 7 and constitute the part that electrically connects to upper ends 310B of connection pins 310.

Referring now to the figures, the second embodiment of the present invention is next explained. In the figures showing this embodiment, constituent elements that are the same as those in the first embodiment of the present invention bear the same reference numerals, and detailed explanation of these components is omitted.

Figure 18:
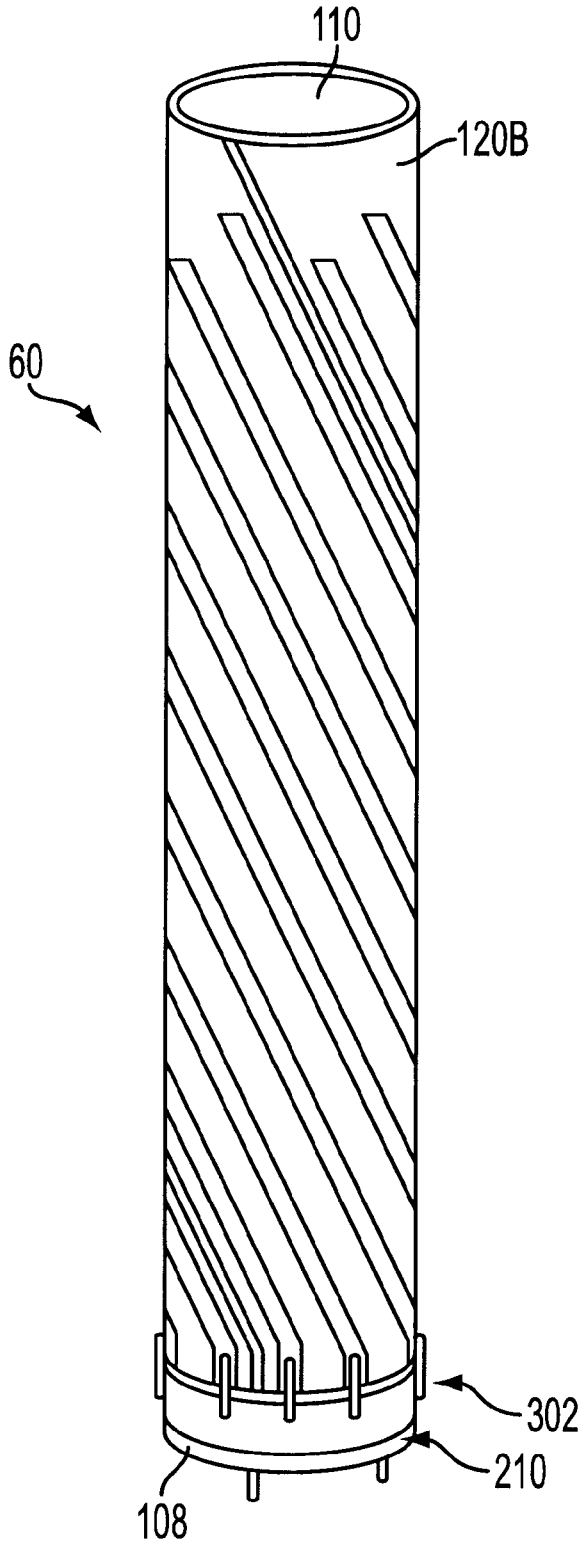
FIG. 18 is a perspective view of a helical antenna according to the second embodiment of the present invention.

Referring to FIG. 18, in which helical antenna 60 of the second embodiment of the present invention is shown, helical antenna 60 of this embodiment differs with respect to the first embodiment in regard to the composition of the flexible print circuit board and the construction of the connection pins.

Figure 19:
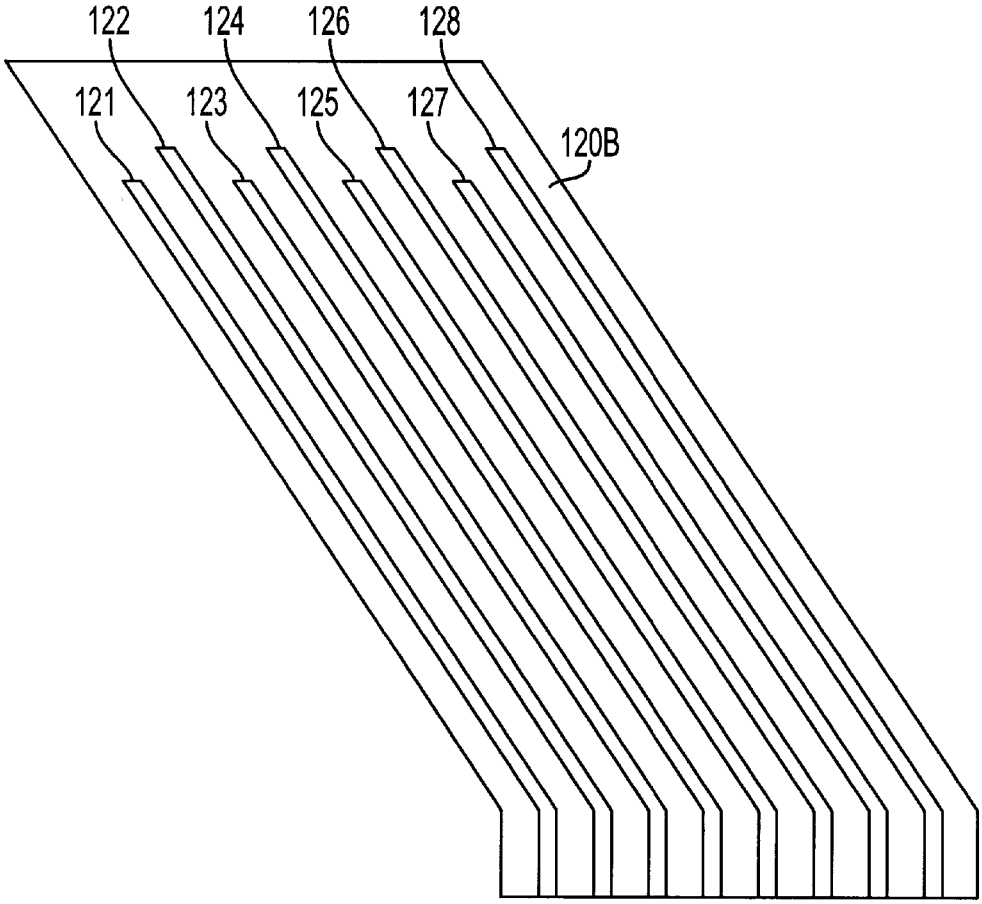
FIG. 19 is a plan development showing the dielectric sheet that makes up a part of the helical antenna of FIG. 18.

In concrete terms, as shown in FIG. 19, eight copper foil patterns 121–128 are formed at fixed intervals with a prescribed angle so as to extend substantially parallel on flexible print circuit board 120B that is used in helical antenna 60 of this embodiment. The lengths of copper foil patterns 121–128 are of two varieties, long and the short patterns being alternately arranged.

Figure 20:
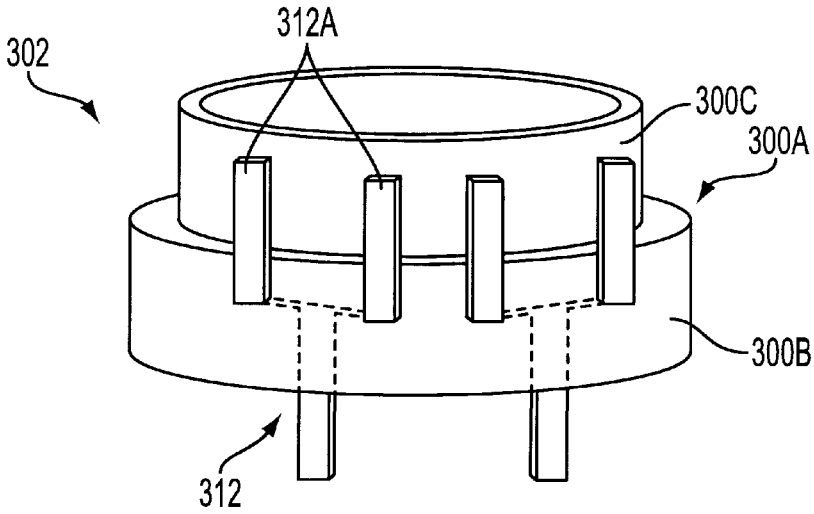
FIG. 20 is a perspective view of the connector that makes up a part of the helical antenna of FIG. 18.
Figure 21:
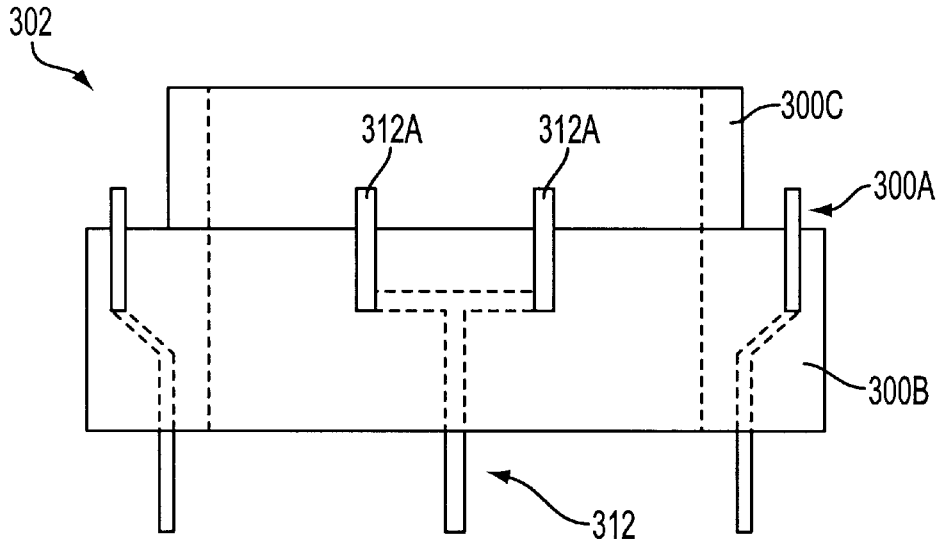
FIG. 21 is a side view of the connector that makes up a part of the helical antenna of FIG. 18.
Figure 22:
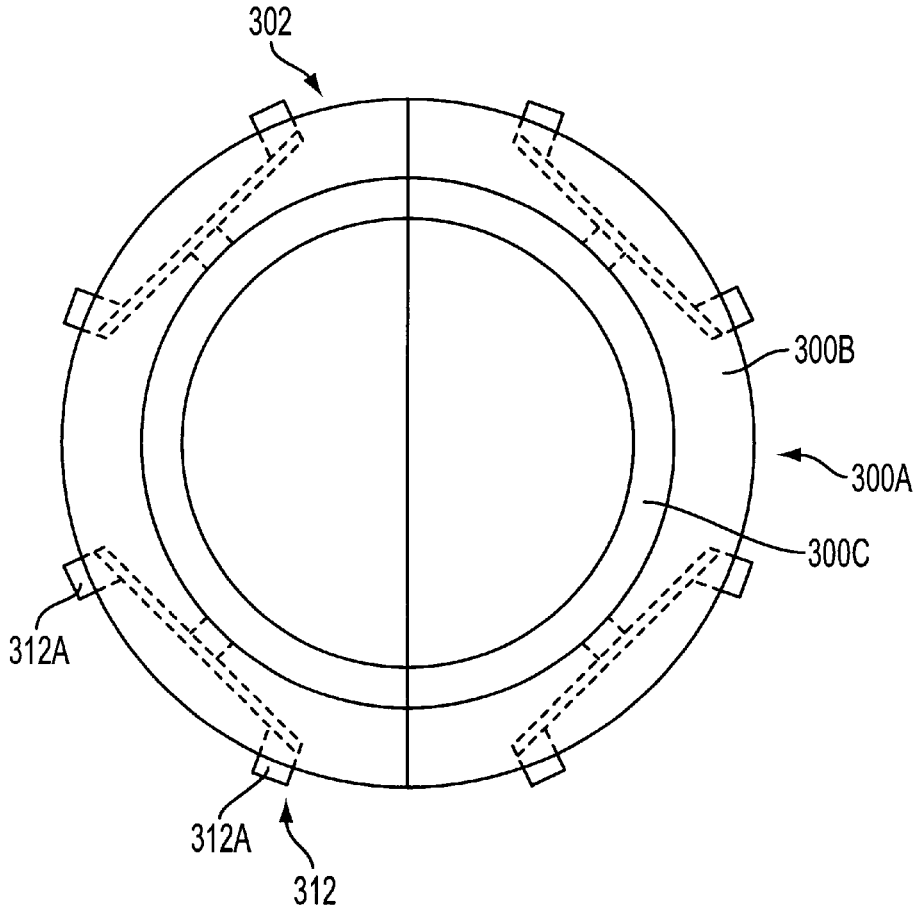
FIG. 22 is a plan view of the connector that makes up a part of the helical antenna of FIG. 18.

In connector 302 that constitutes a part of helical antenna 60, the upper ends of connection pins 312 split into two upper end pins 312A as shown in FIGS. 20–22. Upper end pins 312A protrude from the outer surface of lower portion 300B of ring 300A, extend upward along the outer surface of upper portion 300C of ring 300A and form a gap with the outer surface of upper portion 300C.

The lower ends of connection pins 312, on the other hand, protrude downward from the lower surface of lower portion 300B of connector 302, similar to connector 300 of the first embodiment. In other words, each of connection pins 312 exhibits a Y-shaped form with two upper end pins 312A and one lower end.

As shown in FIG. 18, each upper end pin 312A is connected to a different copper foil pattern 121–128 on flexible print circuit board 120B by soldering.

As with the first embodiment, moreover, a construction may be adopted in which each of upper end pins 312A is provided with a bent portion that is similar to bent portions 310B1 shown in FIG. 15 of the previously described first embodiment, and the elastic pressure of these bent portions against the different copper foil patterns 121–128 on flexible print circuit board 120B establishes electrical contact with upper end pins 312A.

Thus, in a case in which two copper foil patterns that form a pair are not connected to each other at their end portions as in helical antenna 20 of the first embodiment, the upper end pins of a connection pin can be connected to copper foil patterns that form a pair by forming each of the connection pins in a Y shape as described hereinabove as in the present embodiment to obtain the same effect as the first embodiment.

In this embodiment as well, connection pins 312 can be fabricated by the same methods as in the first embodiment.

Figure 23A:
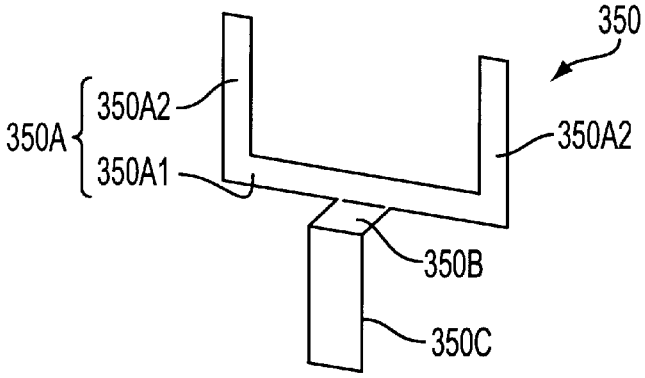
FIGS. 23A–23C are perspective views of modifications of the connection pins.
Figure 23B:
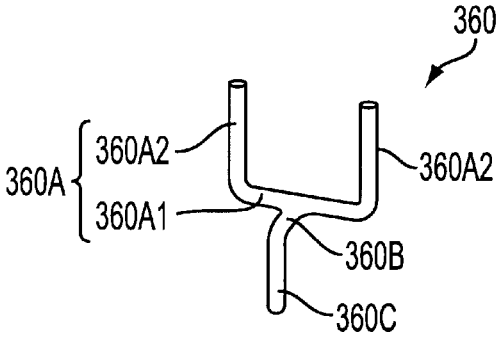
Figure 23C:
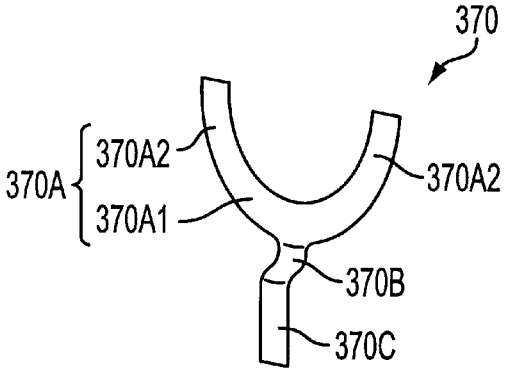

Next, examples of modifications of the connection pins used in this embodiment are described while referring to FIGS. 23A–23C.

Connections pin 350 shown in FIG. 23A are formed from a plate member and are configured to have elasticity in the direction of thickness of the plate member.

Connection pin 350 is made up of upper end portion 350A, middle portion 350B, and lower end portion 350C. Lower end portion 350C is configured to protrude downward from the lower surface of lower portion 300B of connector 302. Middle portion 350B is bent in the direction of thickness of the plate material that makes up connection pins 350 and connects lower end portion 350C to upper end portion 350A. Upper end portion 350A is made up of connection part 350A1 that extends in a direction that is orthogonal to the direction in which lower end portion 350C extends, and two upper end pins 350A2. The middle portion of connection part 350A1 is connected to the end portion of middle portion 350B that is opposite lower end portion 350C. Upper end pins 350A2 are each formed to extend upward from the two ends of connection part 350A1.

In other words, upper end portion 350A splits into two upper end pins 350A2, and a Y shape is formed by this upper end portion 350A, middle portion 350B, and lower end portion 350C.

Connection pin 360 shown in FIG. 23B are formed from a rod material and is configured to have elasticity against the direction of bending.

Connection pin 360 is made up of upper end portion 360A, middle portion 360B, and lower end portion 360C. Lower end portion 360C is configured to protrude downward from the lower surface of lower portion 300B of connector 302. Middle portion 360B is bent in the direction that crosses the direction in which lower end portion 360C extends and connects lower end portion 360C to upper end portion 360A. Upper end portion 360A is made up of connection part 360A1 that extends in a direction that is orthogonal to the direction in which lower end portion 360C extends, and two upper end pins 360A2. The middle portion of connection part 360A1 is connected to the end portion of middle portion 360B that is opposite lower end portion 360C. Upper end pins 360A2 are each formed to extend upward from the two ends of connection part 360Al.

In other words, upper end portion 360A splits into two upper end pins 360A2, and a Y shape is formed by this upper end portion 360A, middle portion 360B, and lower end portion 360C.

Connection pin 370 shown in FIG. 23C is formed from a plate member and is constructed to have elasticity in the direction of thickness of the plate member.

Connection pin 370 is made up of upper end portion 370A, middle portion 370B, and lower end portion 370C. Lower end portion 370C is configured to protrude downward from the lower surface of lower portion 300B of connector 302. Middle portion 370B is bent in the direction of thickness of the plate member that makes up connection pins 370 and connects lower end portion 370C to upper end portion 370A. Upper end portion 370A is made up of connection part 370A1 that extends in a direction that is orthogonal to the direction in which lower end portion 370C extends and two upper end pins 370A2. The middle portion of connection part 370A1 is connected to the end portion of middle portion 370B that is opposite lower end portion 370C. Upper end pins 370A2 are each formed to extend upward from the two ends of connection part 370A1. Finally, connection part 370A1 and upper end pins 370A2 together form a downward bending curve that is open on the upper side.

In other words, upper end portion 370A splits into two upper end pins 370A2, and a Y shape is formed by this upper end portion 370A, middle portion 370B, and lower end portion 370C.

A connector that is provided with the abovedescribed Y-shaped connection pins may also be configured as described hereinbelow.

Figure 24:
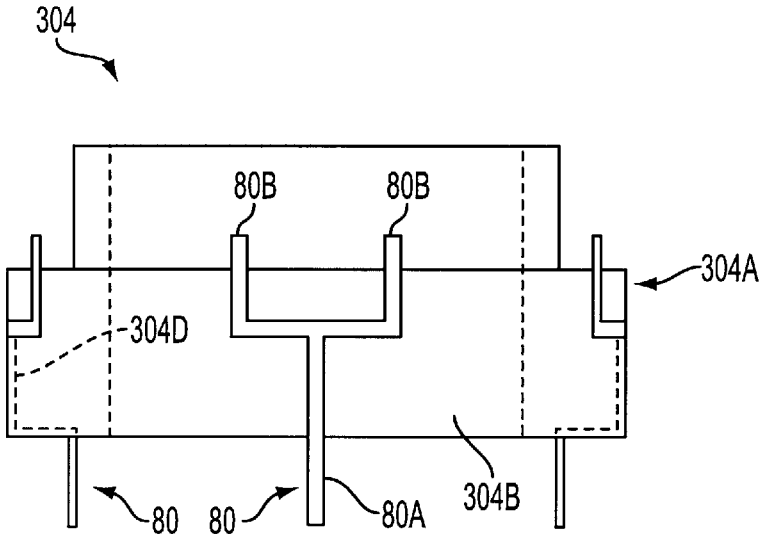
FIG. 24 is a side view showing another modification of the connector provided with Y-shaped connection pins.
Figure 25:
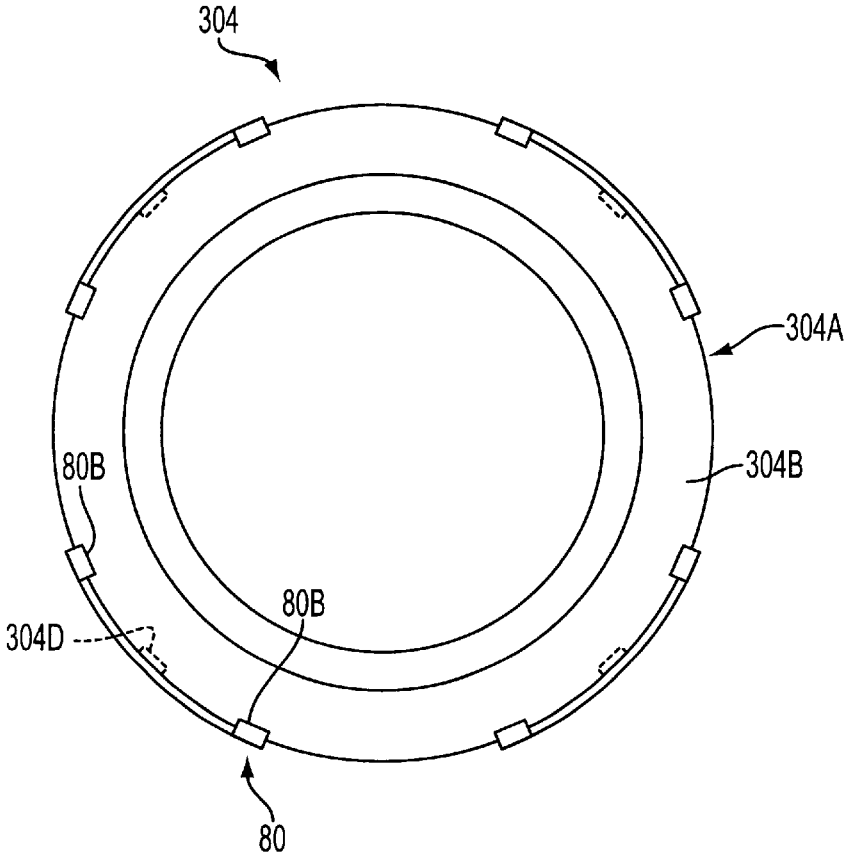
FIG. 25 is a plan view of the connector of FIG. 24.

FIG. 24 is a side view of another example of a connector that can be applied in this invention, and FIG. 25 is a plan view of the same example. As shown in FIGS. 24 and 25, in this connector 304 Y-shaped grooves 304D corresponding to the shape of connection pins 80 are formed for each of connection pins 80 on the outer surface of lower portion 304B of ring 304A. These grooves 304D continue onto the lower surface of lower portion 304B of ring 304A and reach the bases of lower end portions 80A of each of connection pins 80.

The major portion in the middle of each of connection pins 80 is suitably bent so as to be accommodated without gaps within a corresponding groove 304D. Lower end portions 80A of connection pins 80 protrude downward from the lower surface of lower portion 304B of ring 304A. Upper end portions 80B of connection pins 80 protrude upward from lower portion 304B of ring 304A.

Rather than burying a portion of connection pins 80, which constitute a part of connector 304, inside ring 304A as in the above-described embodiment, a method may be adopted in which connection pins 80 are secured to ring 304A by accommodating them inside grooves 304D formed on the outer surface of ring 304A, as in this case. The same effect as the previously described embodiment can of course be obtained when such a method is adopted.

Figure 26:
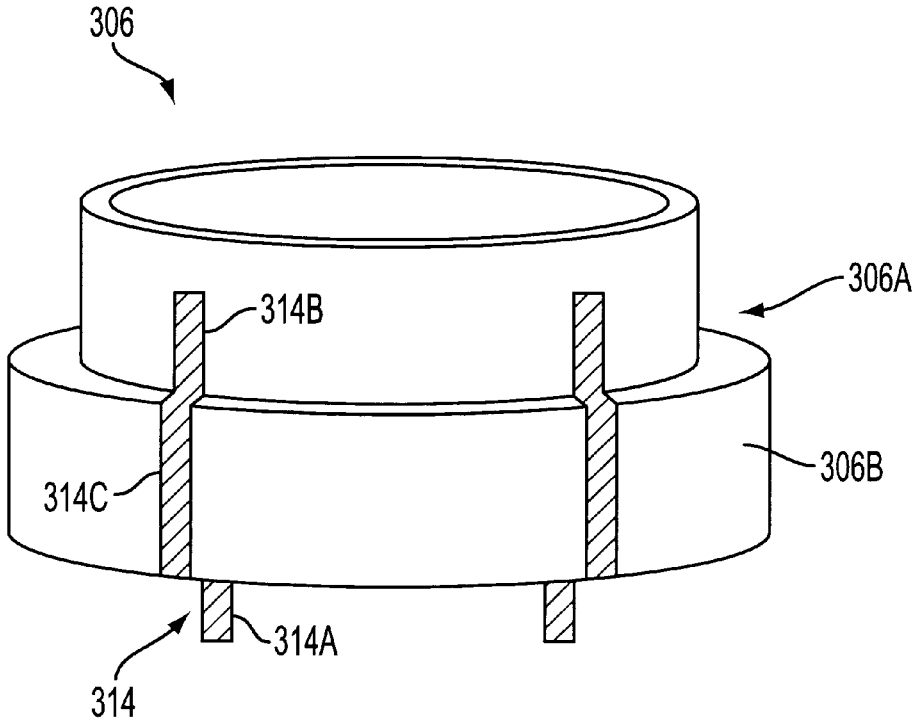
FIG. 26 is a perspective view of yet another example of the connector that makes up a part of the helical antenna of the present invention.
Figure 27:
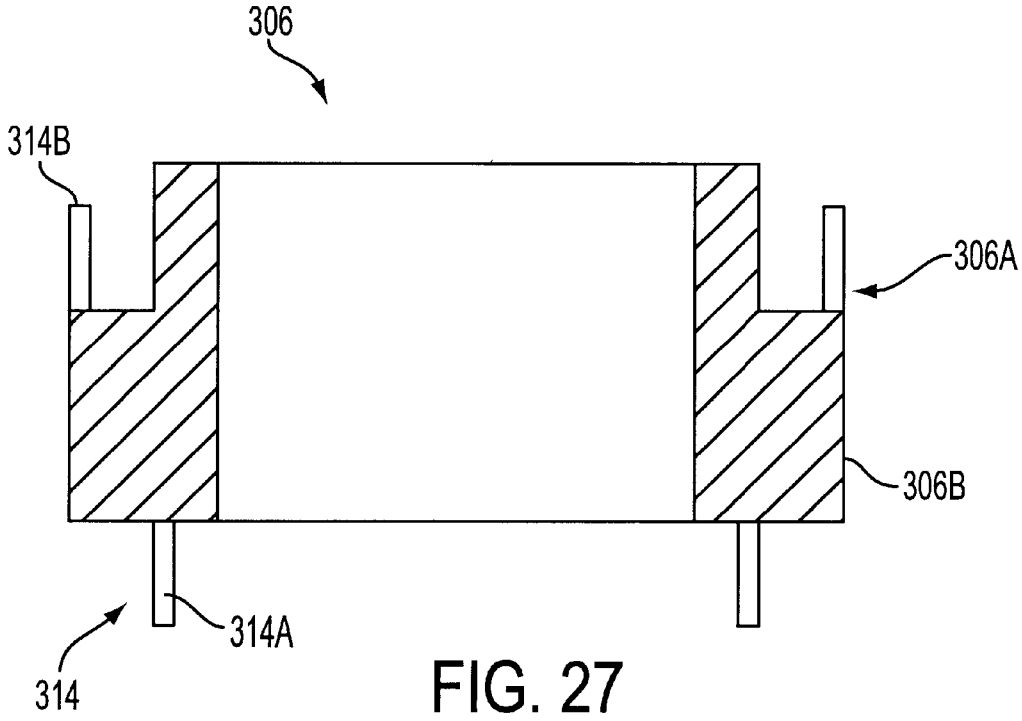
FIG. 27 is a sectional view of the connector of FIG. 26.

FIG. 26 is a perspective view showing yet another example of a connector that can be applied in this invention, and FIG. 27 is a sectional side view of the same example. The shape of connection pins 314 of connector 306 that is shown in FIG. 26 and FIG. 27 differs from that of connector 300 that was used in the first embodiment. In this connector 306, each of connection pins 314 includes upper end pin 314B that forms the upper end portion and lower end pin 314A that forms the lower end portion. Upper end pins 314B and lower end pins 314A are formed as a solid unit with ring 306A, both using the same material as ring 306A, with upper end pins 314B protruding from the upper surface of lower portion 306B of ring 306A and lower end pins 314A protruding from the lower surface of lower portion 306B of ring 306A.

The surfaces of upper end pins 314B and lower end pins 314A as well as the band area on the outer surface of lower portion 306B of ring 306A that joins upper end pins 314 and lower end pins 314A is given continuous plating 314C. As a result, upper end pins 314B and lower end pins 314A are electrically connected by plating 314C and function electrically as connection pins 314.

Connector 306 that includes this type of connection pins 314 therefore can secure and connect the element and feeder circuit in the same way as connector 300 of the first embodiment, and the same effect can be obtained as in the case of helical antenna 20 of the first embodiment.

The above-described plating 314C can be formed by, for example, ordinary MID (Molded interconnect Device) methods.

In the above-described first and second embodiments, a method of winding a flexible print circuit board 120, on which copper foil patterns are formed, around the circumference of dielectric pipe 110 was described as a fabrication method for forming a plurality of copper foil patterns that extend at mutual spacing in a helical form on the outer surface of dielectric pipe 110.

However, this invention allows the adoption of a method for forming a plurality of copper foil patterns at mutual intervals that extend in helical form by ordinary MID methods directly on the outer surface of dielectric pipe 110 (hereinbelow referred to as the "second method"), without using a flexible print circuit board on which copper foil patterns have been formed.

If this second method is adopted, the configuration described in the above-described second embodiment can offer the following operation and effects.

In the above-described second embodiment, the upper ends of the connection pins split into two upper end pins, each upper end pin connecting to a respective first or second copper foil pattern having a different length. In contrast to the first embodiment, therefore, there is no need to connect at bases of the first and second copper foil patterns, i.e., there is no need to provide bases to the first and second copper foil patterns.

Accordingly, first and second copper foil patterns can be achieved with simple shapes that extend substantially parallel to each other instead of employing complicated shapes that are connected at their bases.

In other words, first and second copper foil patterns formed on the outer surface of dielectric pipe 110 exhibit a shape having rotational symmetry with the axis of dielectric pipe 110 as the center. In fabricating element 100, a dielectric pipe is fabricated that is long in the axial direction, and first and second copper foil patterns are then formed in a helical shape by MID techniques on the outer surface of the dielectric pipe.

Element 100 can then be easily manufactured by cutting the dielectric pipe at the required length in the axial direction. This method is possible because the first and second copper foil patterns that are formed on the outer surface of dielectric pipe 110 exhibit rotational symmetry. The use of connection pins that split into two at the upper ends in this way and the simplification of the shape of the copper foil patterns allows element 100 to be manufactured by a simple process and enables a reduction of manufacturing costs.

Figure 29:
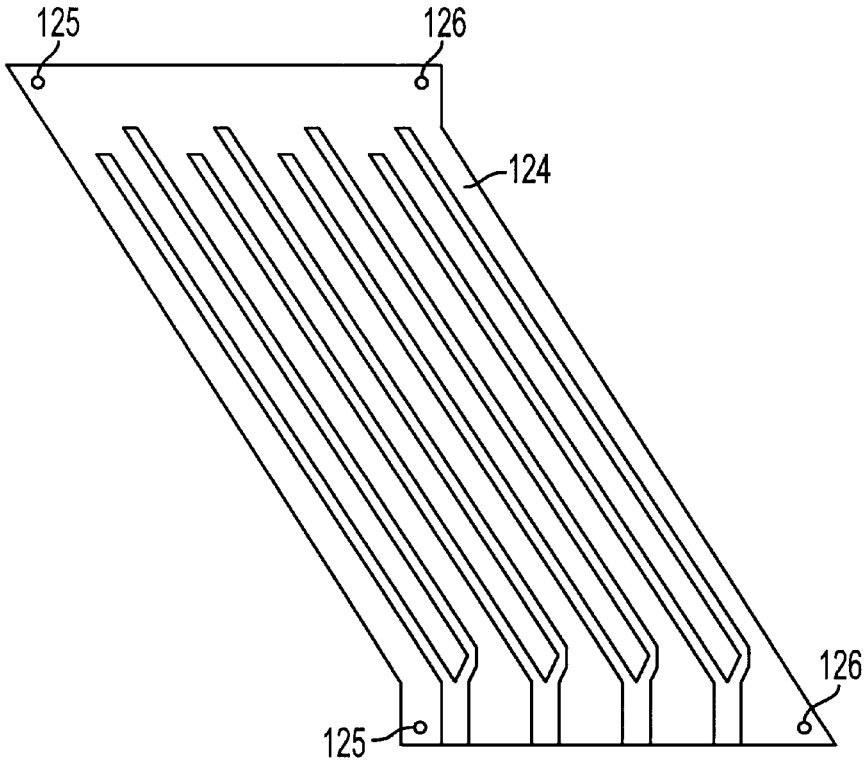
FIG. 29 is a plan development of the flexible print circuit board that makes up a part of the helical antenna of FIG. 28.
Figure 30:
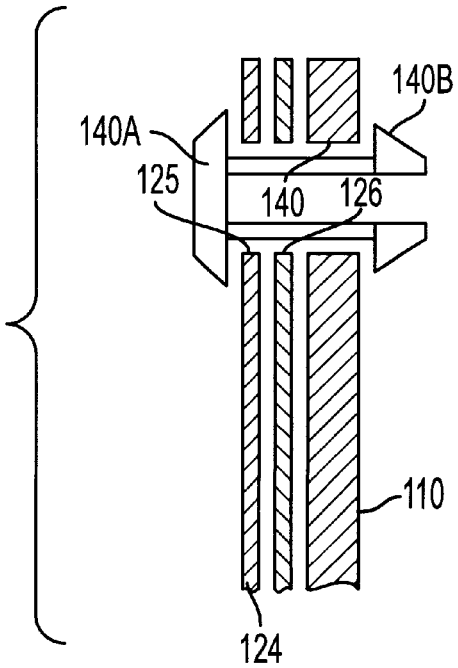
FIG. 30 is an enlarged partial sectional view showing the secured portion of the flexible print circuit board that makes up a part of the helical antenna of FIG. 28.

The third embodiment of the present invention is next explained with reference to FIGS. 28–30. In the figures, constituent elements that are identical to elements of FIG. 1 bear the same reference numerals and redundant explanation of these components is omitted.

Figure 28:
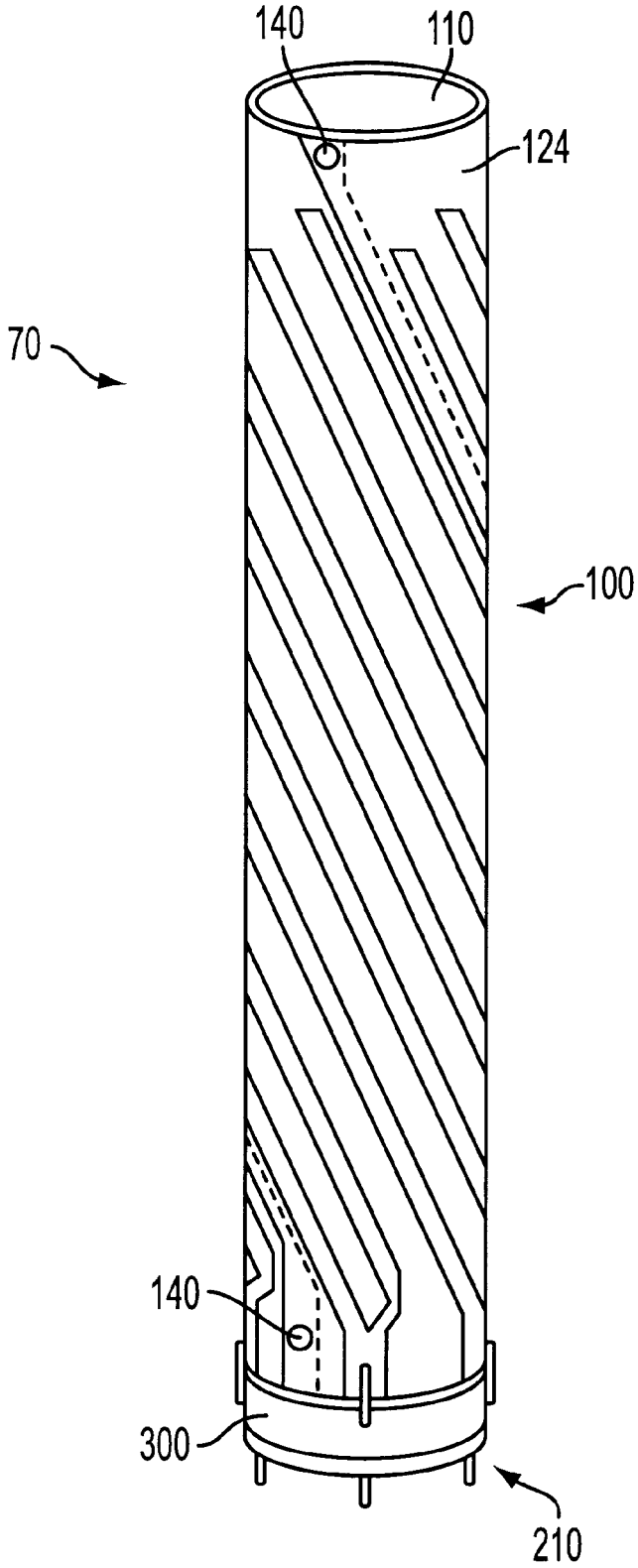
FIG. 28 is a perspective view of the helical antenna according to the third embodiment of the present invention.

Referring to FIG. 28, in which is shown helical antenna 70 according to the third embodiment of the present invention, this helical antenna 70 differs from the helical antenna shown in the first embodiment with regard to the method of securing flexible print circuit board 124. Specifically, as shown in FIG. 29, through-holes 125 and through-holes 126 are formed at the four corners of flexible print circuit board 124 that is used in helical antenna 70 of this embodiment.

When flexible print circuit board 124 is wound onto dielectric pipe 110, through-holes 125 and 126, which form two pairs, are positioned at substantially the same points. In addition, two through-holes 140 that correspond to these through-holes 125 and 126 are formed in dielectric pipe 110. Then, if through-holes 126 on one side of flexible print circuit board 124 are aligned with through-holes 140 on dielectric pipe 110, and flexible print circuit board 124 is wound onto dielectric pipe 110 in this state, the positions of through-holes 140 of dielectric pipe 110 and the pairs of through-holes 125 and 126 on flexible print circuit board 124 all coincide, as shown in FIG. 30. Flexible print circuit board 124 is then secured to dielectric pipe 110 by inserting securing pin 140A through through-holes 125, 126 and 140 in this aligned state. In addition, turned-back portion 140B is formed on the tip of securing pin 140A to prevent dislodging of securing pin 140A.

According to this embodiment, the use of securing pin 140A to secure flexible print circuit board 124 to dielectric pipe 110 fixes flexible print circuit board 124 to dielectric pipe 110 with more reliability.

While preferred embodiments of the present invention have been described using specific terms, such description is for illustrative purposes only, and it is to be understood that changes and variations may be made without departing from the spirit or scope of the following claims.

What is claimed is:

1. A helical antenna comprising:

a cylindrical member composed of a dielectric;

a plurality of radiation elements provided in helical form spaced at intervals from each other on the outer surface of said cylindrical member;

a circuit board that is arranged below said cylindrical member and on which is mounted a feeder circuit for supplying high-frequency energy to said radiation elements; and a connector composed of an insulating material that is arranged between the lower end of said cylindrical member and said circuit board and that has a plurality of connection pins that electrically connect the ends of each of said radiation elements and said circuit board;

wherein said connector comprises a connector body that is formed from said insulating material, and wherein a lower portion of said connector body is formed with an outside diameter that is substantially equal to the outside diameter of said cylindrical member, and an upper portion of said connector body is formed with an outside diameter that allows insertion inside said cylindrical member with substantially no gap.

2. The helical antenna according to claim 1 wherein the lower ends of said connection pins protrude from the lower surface of said lower portion of said connector body, and upper ends of said connection pins protrude from said lower portion of said connector body and extend upward, forming a space between said upper ends of said connection pins and the outer surface of said upper portion of said connector body.

3. The helical antenna according to claim 2 wherein said connector body is configured such that, by inserting said upper portion of said connector body into the lower portion of said cylindrical member, the lower portion of said cylindrical member is interposed between the outer surface of said upper portion of said connector body and the upper ends of said connection pins, thereby joining said connector body to said cylindrical member.

4. The helical antenna according to claim 3 wherein the electrical connection between the ends of said radiation elements and said circuit board by said connection pins is realized by the electrical connection between the upper ends of said connection pins and the ends of said radiation elements and the electrical connection between the lower ends of said connection pins and said circuit board.

5. A helical antenna comprising:

a cylindrical member composed of a dielectric;

a plurality of radiation elements that are provided in helical form spaced at intervals from each other on the outer surface of said cylindrical member;

a circuit board that is arranged below said cylindrical member and on which is mounted a feeder circuit for supplying high-frequency energy to said radiation elements; and a connector composed of an insulating material; wherein: said connector includes a connector body and a plurality of connection pins composed of a conductive material;

a lower portion of said connector body is formed with an outside diameter that is substantially equal to the outside diameter of said cylindrical member;

an upper portion of said connector body is formed with an outside diameter that allows insertion inside said cylindrical member with substantially no gap;

the lower ends of said connection pins protrude downward from the lower surface of said lower portion of said connector body;

the upper ends of said connection pins protrude upward from said lower portion of said connector body to form a space between said upper ends of said connection pins and the outer surface of said upper portion of said connector body;

said connector body is joined to said cylindrical member by inserting said upper portion inside the lower end of said cylindrical member and interposing the lower end of said cylindrical member between the outer surface of said upper portion of said connector body and the upper ends of said connection pins;

the upper ends of each of said connection pins are electrically connected to a respective end of each of said radiation elements; and the lower ends of said connection pins are electrically connected to said circuit board that is arranged below said connector.

6. The helical antenna according to claim 5 wherein the parts of said lower ends of said connection pins that protrude from the lower surface of said lower portion of said connector body are positioned closer to the center in the radial direction of said connector body than said upper ends of said connection pins.

7. The helical antenna according to claim 5 wherein a plurality of through-holes are formed along the edge of said circuit board and said lower end of each of said connection pins is inserted into a respective one of said through-holes to electrically connect with said feeder circuit.

8. The helical antenna according to claim 5 wherein the upper ends of each of said connection pins protrude from the outer surface of said lower portion of said connector body and extend up along the outer surface of said upper portion of said connector body.

9. The helical antenna according to claim 8 wherein the parts of the upper ends of each of said connection pins that extend up along the outer surface of said upper portion of said connector body are constructed to elastically press against the ends of said radiation elements, and wherein electrical connection between the upper ends of each of said connection pins and the ends of said radiation elements is established by the pressure between the upper ends of each of said connection pins and the ends of each of said radiation elements.

10. The helical antenna according to claim 5 wherein the upper end of each of said connection pins splits into two upper end pins that each electrically connects to a different one of said radiation elements.

11. The helical antenna according to claim 10 wherein said connection pins are each formed in a substantially Y-shaped form composed of said two upper end pins and one lower end that is connected in common to the lower portions of said two upper end pins.

12. The helical antenna according to claim 5 wherein each of said connection pins is constructed from a plate member.

13. The helical antenna according to claim 5 wherein each of said connection pins is constructed from a rod member.

14. The helical antenna according to claim 5 wherein a plurality of grooves are formed on the outer surface of said lower portion of said connector body for accommodating at least a portion of each of said connection pins, and at least a portion of each of said connection pins are inserted into said grooves to secure said connection pins to said connector body.

15. The helical antenna according to claim 5 wherein said connection pins comprise:

an upper end pin portion that is of the same material as said connector body, that protrudes from the upper surface of said lower portion of said connector body, and that is formed as a solid unit with said connector body;

a lower end pin portion that is of the same material as said connector body, that protrudes from the lower surface of said lower portion of said connector body, and that is formed as a solid unit with said connector body; and a plated portion that is formed continuously on areas of the surface of said upper end pin portion, the surface of said lower end pin portion, and the surface of said connector body that join said upper end pin portion and said lower end pin portion.

16. The helical antenna according to claim 5 wherein:

each of said radiation elements is constructed from a first and a second radiation element that each extend substantially parallel to the other, and a radiation element base that connects said first and second radiation elements at the lower end of said cylindrical member; and each of said radiation element bases is connected to a respective one of said connection pins.

17. The helical antenna according to claim 16 wherein said radiation element bases each exhibit a Y shape, a U shape, or a V shape to connect together the ends of said first and second radiation elements.

18. The helical antenna according to claim 10 wherein:

each of said radiation elements is constructed from a first and a second radiation element that each extends substantially parallel to the other; and said first and second radiation elements are connected each to a different one of said upper end pins of the same connection pin.

19. The helical antenna according to claim 5 wherein said radiation elements are constituted from metal foil patterns that are formed on the surface of a dielectric sheet that is wound onto the outer surface of said cylindrical member.

20. The helical antenna according to claim 19 wherein said dielectric sheet is a sheet that is substantially a parallelogram in shape and that is wound onto the outer surface of said cylindrical member in a helical form.

21. The helical antenna according to claim 20 wherein:

through-holes are formed in each of the four corners of said dielectric sheet that correspond to the upper end and lower end of the portions of said sheet that overlap when said dielectric sheet is wound onto said cylindrical member;

through-holes are formed in the upper end and lower end of said cylindrical member that correspond to the positions of said through-holes formed in said dielectric sheet when said dielectric sheet is wound onto said cylindrical member; and said dielectric sheet is secured to said cylindrical member by securing pins at the upper end and lower end of said dielectric sheet, each securing pin passing through two overlapping through-holes of said dielectric sheet and a through-hole of said cylindrical member.

22. The helical antenna according to claim 21 wherein a turned-back portion is formed at the tip of each of said securing pins to prevent dislodging of said securing pins from said through-holes.

23. The helical antenna according to claim 5 wherein said radiation elements are constituted from metal foil patterns that are formed by a Molded Interconnect Device technique on the outer surface of said cylindrical member.

24. The helical antenna according to claim 5 wherein the number of said radiation elements is at least four.

25. A method of fabricating a helical antenna, comprising the steps of:

preparing a cylindrical member that is provided with a plurality of radiation elements that are provided in a helical form spaced at intervals from each other on the outer surface of said cylindrical member;

preparing a circuit board on which is mounted a feeder circuit for supplying high-frequency energy to said radiation elements;

preparing a connector that is composed of an- insulating material and that has a plurality of connection pins for electrically connecting the ends of each of said radiation elements to said circuit board;

installing said connector on said circuit board and electrically connecting said feeder circuit and each of said connection pins; and attaching said connector to the lower end of said cylindrical member and electrically connecting the ends of said radiation elements to each of said connection pins;

wherein said step of preparing said connector includes forming a connector body from an insulating material in a shape having a lower portion that has an outside diameter that is substantially equal to the outside diameter of said cylindrical member and an upper portion that has an outside diameter that allows insertion into said cylindrical member with substantially no gap.

26. The method of fabricating a helical antenna according to claim 25 wherein said step of preparing said connector includes: causing the lower ends of each of said connection pins to protrude from the lower surface of said lower portion of said connector body, and causing the upper ends of each of said connection pins to protrude upward from said lower portion of said connector body with a gap between said upper ends of each of said connection pins and the outer surface of said upper portion of said connector body.

27. The method of fabricating a helical antenna according to claim 26 wherein said step of electrically connecting the ends of said radiation elements and each of said connection pins includes joining said connector and said cylindrical member by inserting said upper portion of said connector body into the lower end of said cylindrical member and interposing the lower end of said cylindrical member between the outer surface of said upper portion of said connector body and the upper ends of said connection pins.

28. The method of fabricating a helical antenna according to claim 27 wherein said step of electrically connecting said feeder circuit and each of said connection pins includes: arranging said feeder circuit below said connector, and electrically connecting the lower ends of each of said connection pins to said circuit board.

29. A method of fabricating a helical antenna comprising the steps of:

preparing a cylindrical member that is provided with a plurality of radiation elements that are provided in a helical form spaced at intervals from each other on the outer surface of said cylindrical member;

preparing a circuit board on which is mounted a feeder circuit for supplying high-frequency energy to said radiation elements;

preparing a connector that includes a connector body that is composed of an insulating material and a plurality of connection pins for electrically connecting the ends of each of said radiation elements to said circuit board, said connector body being formed in a shape having a lower portion that has an outside diameter that is equal to the outside diameter of said cylindrical member and an upper portion that has an outside diameter that allows insertion into said cylindrical member with substantially no gap, the lower ends of each of said connection pins protruding from the lower surface of said lower portion of said connector body and the upper ends of each of said connection pins-protruding up from said lower portion of said connector body and forming a gap between said upper ends of said connection pins and the outer surface of said upper portion of said connector body;

joining said connector and said cylindrical member by inserting said upper portion of said connector body inside the lower end of said cylindrical member and interposing the lower end of said cylindrical body between the outer surface of said upper portion of said connector body and the upper ends of each of said connection pins;

electrically connecting the ends of said radiation elements and the upper ends of each of said connection pins; and electrically connecting said feeder circuit and the lower ends of each of said connection pins.

30. The method of fabricating a helical antenna according to claim 29 wherein said step of preparing said connector includes positioning the parts of the lower ends of said connection pins that protrude from the lower surface of said lower portion of said connector body closer to the center in the radial direction of said connector body than the upper ends of said connection pins.

31. The method of fabricating a helical antenna according to claim 29 wherein:

said step of preparing said circuit board includes forming a plurality of through-holes along the edge of said circuit board that are each electrically connected to said feeder circuit; and said step of electrically connecting said feeder circuit and the lower ends of each of said connection pins includes inserting the lower ends of each of said connection pins through a respective one of said through-holes.

32. The method of fabricating a helical antenna according to claim 29 wherein said step of preparing said connector includes forming the upper ends of each of said connection pins such that said upper ends of said connection pins each protrude from the outer surface of said lower portion of said connector body and extend upward along the outer surface of said upper portion of said connector body.

33. The method of fabricating a helical antenna according to claim 32 wherein:

said step of preparing said connector includes configuring the parts of the upper ends of each of said connection pins that extend upward along the outer surface of said upper portion of said connector body such that each presses elastically against the end of a respective one of said radiation elements; and said step of electrically connecting the ends of said radiation elements to the upper ends of each of said connection pins includes causing the upper ends of each of said connection pins to press against the end of a respective one of each of said radiation elements.

34. The method of fabricating a helical antenna according to claim 29 wherein:

said step of preparing said connector includes forming the upper ends of each of said connection pins such that the upper end of each connection pin splits into two upper end pins; and said step of electrically connecting the ends of said radiation elements to the upper ends of each of said connection pins includes electrically connecting each of said upper end pins, that have been split into two pins to a different one of said radiation elements.

35. The method of fabricating a helical antenna according to claim 34 wherein said step of preparing said connector includes forming each of said connection pins in substantially a Y shape composed of said two upper end pins and one lower portion that is connected-in common to the bottom portions of said two upper pins.

36. The method of fabricating a helical antenna according to claim 29 wherein said step of preparing said connector includes forming each of said connection pins by including the steps of:

forming, as a solid unit with said connector body, an upper end pin portion that is of the same material as said connector body and that protrudes from the upper surface of said lower portion of said connector body;

forming, as a solid unit with said connector body, a lower end pin portion that is of the same material as said connector body and that protrudes from the lower surface of said lower portion of said connector body; and forming a continuous plated portion on areas of the surface of said upper end pin portion, the surface of said lower end pin portion, and the surface of said connector body that join said upper end pin portion and said lower end pin portion.

37. The method of fabricating a helical antenna according to claim 29 wherein:

said step of preparing said cylindrical member includes constructing each of said radiation elements from a first and a second radiation element that each extends substantially parallel to the other, and a radiation element base that connects said first and second radiation elements at the lower end of said cylindrical member; and said step of electrically connecting the ends of said radiation elements and each of said connection pins includes electrically connecting each of said connection pins to a respective one of said radiation element bases.

38. The method of fabricating a helical antenna according to claim 34 wherein:

said step of preparing said cylindrical member includes constructing each of said radiation elements from a first and a second radiation element that each extends substantially parallel to the other; and said step of electrically connecting the ends of said radiation elements to each of said connection pins includes connecting one of said two upper end pins to said first radiation element and connecting the other of said two upper end pins to said second radiation element.

39. The method of fabricating a helical antenna according to claim 29 wherein said step of preparing said cylindrical member includes: forming metal foil patterns that constitute said radiation elements on the surface of a dielectric sheet, and winding said dielectric sheet onto the outer surface of said cylindrical member.

40. The method of fabricating a helical antenna according to claim 39 wherein said step of preparing said cylindrical member includes forming said dielectric sheet as a sheet that is substantially a parallelogram in shape, and winding said dielectric sheet onto the outer surface of said cylindrical member in helical form.

41. The method of fabricating a helical antenna according to claim 40 wherein said step of preparing said cylindrical member includes:

forming through-holes at the four corners of said dielectric sheet that correspond to the upper end and lower end of the portions of said dielectric sheet that overlap when said dielectric sheet is wound onto said cylindrical member;

forming through-holes in the upper end and lower end of said cylindrical member at positions that correspond to the positions of through-holes in said dielectric sheet when said dielectric sheet is wound onto said cylindrical member;

winding said dielectric sheet onto said cylindrical member and aligning the through-holes of said dielectric sheet with the positions of the through-holes in said cylindrical member; and passing securing pins through the two overlapping through-holes of said dielectric sheet and the through-hole of said cylindrical member both at the upper end and lower end of said dielectric sheet to secure said dielectric sheet to the outer surface of said cylindrical member.

42. The method of fabricating a helical antenna according to claim 41 wherein said step of preparing said cylindrical member further includes forming a turned-back portion on the tip of each of said securing pins to prevent dislodging of said securing pins from said through-holes.

43. The method of fabricating a helical antenna according to claim 29 wherein said step of preparing said cylindrical member includes constructing said radiation elements from metal foil patterns that are formed on the outer surface of said cylindrical member by Molded Interconnect Device methods.

44. The method of fabricating a helical antenna according to claim 29 wherein the number of said radiation elements is at least four.

* * * * *

UNITED STATES PATENT AND TRADEMARK OFFICE

CERTIFICATE OF CORRECTION

PATENT NO. : 6,421,029 B1
DATED : July 16, 2002
INVENTOR(S) : Kosuke Tanabe

It is certified that error appears in the above-identified patent and that said Letters Patent is hereby corrected as shown below:

Title page,
Item [57], ABSTRACT,
Line 5, delete "the." insert -- the --

Column 1,
Line 42, delete "110" insert -- 100 --

Column 6,
Line 37, delete "108BC" insert -- 108B --

Column 7,
Line 51, delete "108Di" insert -- 108D1 --

Column 9,
Line 37, delete "310B3" insert -- 310B --
Line 49, delete "31011" insert -- 310B1 --

Signed and Sealed this

Twenty-sixth Day of November, 2002

*Attest:*

*Attesting Officer*

JAMES E. ROGAN
*Director of the United States Patent and Trademark Office*